US009101937B2

(12) United States Patent
Kitamura et al.

(10) Patent No.: US 9,101,937 B2
(45) Date of Patent: Aug. 11, 2015

(54) PRECISE TEMPERATURE CONTROLLING UNIT AND METHOD THEREOF

(75) Inventors: Shigeru Kitamura, Kyoto (JP); Naoyuki Nakanishi, Kyoto (JP)

(73) Assignee: ARKRAY, Inc., Kyoto (JP)

( * ) Notice: Subject to any disclaimer, the term of this patent is extended or adjusted under 35 U.S.C. 154(b) by 458 days.

(21) Appl. No.: 13/504,732

(22) PCT Filed: Oct. 29, 2010

(86) PCT No.: PCT/JP2010/069290

§ 371 (c)(1),
(2), (4) Date: May 22, 2012

(87) PCT Pub. No.: WO2011/052723

PCT Pub. Date: May 5, 2011

(65) Prior Publication Data

US 2012/0247725 A1 Oct. 4, 2012

(30) Foreign Application Priority Data

Oct. 30, 2009 (JP) ..... 2009-251040

(51) Int. Cl.

| | |
|---|---|
| ***H05B 1/02*** | (2006.01) |
| ***B01L 7/00*** | (2006.01) |
| *B01L 3/00* | (2006.01) |

(52) U.S. Cl.

CPC ..... *B01L 7/525* (2013.01); *B01L 3/5027* (2013.01); *B01L 2300/0816* (2013.01); *B01L 2300/1805* (2013.01); *B01L 2300/185* (2013.01)

(58) Field of Classification Search

CPC ..... H05B 1/025; H05B 1/0244; B01L 2300/0816; B01L 2300/1805; B01L 2300/185

USPC ..... 219/494, 497, 505, 521, 388, 385; 422/65, 67; 435/287 J, 290, 285.1, 435/286.1, 288.1

See application file for complete search history.

(56) References Cited

U.S. PATENT DOCUMENTS

| | | | | | |
|---|---|---|---|---|---|
| 4,865,986 | A | * | 9/1989 | Coy et al. | 435/285.1 |
| 5,161,609 | A | * | 11/1992 | Dutertre et al. | 165/267 |
| 5,446,263 | A | * | 8/1995 | Eigen et al. | 219/521 |
| 6,015,534 | A | * | 1/2000 | Atwood | 422/550 |

(Continued)

FOREIGN PATENT DOCUMENTS

| | | |
|---|---|---|
| DE | 19646114 B4 | 9/2004 |
| JP | 04-501530 A | 3/1992 |

(Continued)

OTHER PUBLICATIONS

International Search Report issued in corresponding PCT International Application No. PCT/JP2010/069290, mailed Jan. 18, 2011.
Extended European Search Report issued in corresponding European Patent Application No. 10826853.3 dated Jul. 16, 2014.

*Primary Examiner* — Mark Paschall
(74) *Attorney, Agent, or Firm* — Morgan, Lewis & Bockius LLP

(57) ABSTRACT

A temperature controlling unit (X1) includes a holder (11) for a liquid receiver (40), a heating block (12) for heating the liquid in the liquid receiver (40), and a cooling block (13) for cooling the liquid in the liquid receiver (40). The holder (11) maintains a first temperature for keeping the temperature of the liquid in the liquid receiver (40) at a lower target temperature. The heating block (12) maintains a second temperature higher than a higher target temperature above the lower target temperature. The cooling block (13) maintains a third temperature lower than the lower target temperature. A temperature controlling method of the present invention includes a heating step for bringing a heating block (12) into contact with the liquid receiver (40) held by the holder (11) and a cooling step for bringing a cooling block (13) into contact with the liquid receiver (40) held by the holder (11).

13 Claims, 16 Drawing Sheets

(56) References Cited

U.S. PATENT DOCUMENTS

| | | | | |
|---|---|---|---|---|
| 7,030,340 | B2 | 4/2006 | Knoche | |
| 7,182,130 | B2 * | 2/2007 | Ohki | 165/263 |
| 7,745,205 | B2 * | 6/2010 | Wittwer et al. | 435/287.2 |
| 7,754,473 | B2 * | 7/2010 | Nurmi et al. | 435/287.1 |
| 2008/0286161 | A1 * | 11/2008 | Heaney et al. | 422/102 |
| 2009/0001973 | A1 | 1/2009 | May et al. | |
| 2013/0323796 | A1 * | 12/2013 | Chesnut et al. | 435/91.5 |

FOREIGN PATENT DOCUMENTS

| | | | |
|---|---|---|---|
| JP | 06-277036 | A | 10/1994 |
| JP | 08-117590 | A | 5/1996 |
| JP | 2000-270837 | A | 10/2000 |
| JP | 2002-306154 | A | 10/2002 |
| JP | 2006-238848 | A | 9/2006 |
| WO | 2008/027398 | A2 | 3/2008 |
| WO | 2009/000604 | A1 | 12/2008 |

* cited by examiner

PRECISE TEMPERATURE CONTROLLING UNIT AND METHOD THEREOF

The present application is a U.S. National Phase Application of International Application No. PCT/JP2010/069290, filed Oct. 29, 2010, which claims the benefit of priority of Japanese Application No. 2009-251040 filed Oct. 30, 2009, the disclosures of which are incorporated herein by reference in their entireties.

TECHNICAL FIELD

The present invention relates to a temperature controlling unit that can be used as a PCR machine, for example. The present invention also relates to a temperature controlling method that can be used for PCR methods.

BACKGROUND ART

Apparatuses for controlling the temperature of a liquid are currently used in various technical fields. For instance, in biochemistry, temperature controlling units for controlling the temperature of a sample liquid are used. Examples of known temperature controlling units include a PCR machine for performing a PCR (polymerase chain reaction) method. As to PCR methods, description is given in e.g. Patent Documents 1 and 2 identified below.

FIG. 17 shows an example of conventional PCR machine. The illustrated PCR machine X2 includes a holding block 91, a heating block 92 and a cooling block 93. In the PCR machine X2, a cycle including thermal denaturation, annealing and elongation is repeated a plurality of times.

The holding block 91 is formed with a plurality of recesses 91*a* for receiving tubes 94. Each of the tubes 94 contains a reaction sample liquid or the like for performing a PCR method. The reaction sample liquid contains template DNA, primer DNA, DNA polymerase, and dNTP. The holding block 91 is transferred by a transfer member (not shown) to a position above the heating block 92 (FIG. 18) or a position above the cooling block 93 (FIG. 19). The heating block 92 is provided for supplying heat to the holding block 91 and thermally connected to a heating device (not shown). The cooling block 93 is provided for taking heat from the holding block 91 and thermally connected to a heat-absorbing device (not shown).

In the PCR machine X2, a PCR method is performed as described below, for example.

First, the holding block 91 is placed on the heating block 92 and heated by the heating block 92 (temperature increase step). In this step, the heating block 92 is kept at a thermal denaturation temperature $T_{11}$ (e.g. 95° C.) by the heating device.

When the holding block 91 substantially reaches the thermal denaturation temperature $T_{11}$, the reaction sample liquid in the tubes 94 held by the holding block 91 also reaches the denaturation temperature $T_{11}$, so that a thermal denaturation step starts. In the thermal denaturation step, two strands of a template DNA are separated from each other.

After the thermal denaturation step, the holding block 91 is transferred to and placed on the cooling block 93 and cooled by the cooing block 93 (temperature reduction step). In this step, the cooling block 93 is kept at an annealing/elongation temperature $T_{12}$ (e.g. 60° C.) by the operation of the heat-absorbing device, not shown.

When the holding block 91 substantially reaches the annealing/elongation temperature $T_{12}$, the reaction sample liquid in the tubes 94 held by the holding block 91 also reaches the annealing/elongation temperature $T_{12}$, so that an annealing/elongation step (the step in which annealing and elongation proceed at the same time) starts. In the annealing step, each single-stranded DNA of the template combines with a primer (containing a base sequence complementary to part of the single-stranded DNA). In the elongation step, at the 3' end of the primer combined with the single-stranded DNA of the template, a DNA strand containing a base sequence complementary to a single-stranded DNA is elongated or synthesized.

In the PCR machine X2, the cycle including the above-described steps is repeated a plurality of times, whereby apiece of DNA having a predetermined base sequence is amplified.

Patent Document 1: JP-A-4-501530

Patent Document 2: JP-A-6-277036

FIG. 20 is a graph showing an example of temperature change of a reaction sample liquid in each cycle of the above-described PCR method performed by the PCR machine X2. As shown in the graph of FIG. 20, in the temperature increase step, the temperature increase speed in a temperature range close to the target temperature (thermal denaturation temperature $T_{11}$) is considerably low as compared with the temperature increase speed in the initial stage of the temperature increase step. In this way, with the PCR machine X2, the reaction sample liquid reaches the thermal denaturation temperature $T_{11}$ after going through the temperature range in which the temperature increase speed is considerably low. Thus, it is necessary to secure sufficient time for the temperature increase step. Moreover, in the temperature reduction step, the temperature reduction speed in a temperature range close to the target temperature (the annealing/elongation temperature $T_{12}$) is considerably low as compared with the temperature reduction speed in the initial stage of the temperature reduction step. In this way, with the PCR machine X2, the reaction sample liquid reaches the annealing/elongation temperature $T_{12}$ after going through the temperature range in which the temperature reduction speed is considerably low. Thus, it is necessary to secure sufficient time for the temperature reduction step as well. Thus, the PCR machine X2 is not suitable for completing the temperature increase step and the temperature reduction step in a short period of time. In other words, the PCR machine X2 is not suitable for quickly changing the temperature of a reaction sample liquid (liquid).

SUMMARY OF THE INVENTION

The present invention has been proposed under the circumstances described above. It is therefore an object of the present invention to provide a temperature controlling unit and a temperature controlling method suitable for quickly changing the temperature of a liquid.

According to a first aspect of the present invention, there is provided a temperature controlling unit. The temperature controlling unit comprises a holder, a heating block and a cooling block. The holder is provided for holding a liquid receiver containing a liquid in contact with the liquid receiver and is configured to maintain a first temperature ($T_1$) for keeping the temperature of the liquid at a lower target temperature ($T_L$). The heating block is provided for increasing the temperature of the liquid through contact with the liquid receiver. The heating block is movable relative to the liquid receiver and configured to maintain a second temperature ($T_2$) higher than a higher target temperature ($T_H$) that is higher than the lower target temperature ($T_L$). The cooling block is provided for reducing the temperature of the liquid through contact with the liquid receiver. The cooling block is movable relative to the liquid receiver and configured to maintain a third temperature ($T_3$) lower than the lower target temperature ($T_L$).

The liquid or target, subjected to temperature control by the temperature controlling unit, is received in a liquid receiver, and the liquid receiver is held by a holder. During the operation of the unit, the temperature of the holder is set to and maintained at a first temperature for keeping the temperature of the liquid in the liquid receiver at a lower target temperature. Here, the first temperature for keeping the temperature of the liquid in the liquid receiver at a lower target temperature, is a temperature by which the temperature of the liquid in the liquid receiver will be changed and subsequently kept at the lower target temperature when a sufficient time has elapsed in a state where no heat transfer occurs from the heating block to the liquid receiver or the liquid and no heat transfer from the liquid receiver or the liquid to the cooling block. The above-defined first temperature may be set depending on, for example, the lower target temperature, environmental temperature, thermal conductivity of the material for the liquid receiver, and the structure and heat dissipation ability of the liquid receiver. For instance, when the lower target temperature is equal or substantially equal to the environmental temperature, it may be suitable to set the first temperature of the holder to be equal to the lower target temperature. When the lower target temperature is considerably higher than the environmental temperature, it may be suitable to set the first temperature of the holder to be higher than the lower target temperature. When the lower target temperature is considerably lower than the environmental temperature, it may be suitable to set the first temperature of the holder to be lower than the lower target temperature.

The temperature increase by the temperature controlling unit is performed by causing the heating block, which is movable relative to the liquid receiver, to come closer to and into contact with the liquid receiver. At least during the temperature increase step, the temperature of the heating block is set to and maintained at a second temperature. It is preferable that the temperature of the heating block is maintained at the second temperature during the operation of the unit. The second temperature is higher than a higher target temperature (that is higher than the lower target temperature) for the liquid in the liquid receiver. For instance, in the temperature increase step by the temperature control unit, heat transfer from the heating block to the liquid receiver or the liquid is stopped by separating the heating block from the liquid receiver when the temperature of the liquid in the liquid receiver has reached the higher target temperature.

The temperature reduction by the temperature controlling unit is performed by causing the cooling block, which is movable relative to the liquid receiver held by the holder kept at the first temperature, to come closer to and into contact with the liquid receiver. At least during the temperature reduction step, the temperature of the cooling block is set to and maintained at a third temperature. It is preferable that the temperature of the cooling block is maintained at the third temperature during the operation of the unit. The third temperature is lower than the lower target temperature for the liquid in the liquid receiver. When the first temperature of the holder is lower than the lower target temperature, the third temperature of the cooling block is set to be lower than the first temperature. For instance, in the temperature reduction step by the temperature control unit, heat transfer from the liquid receiver or the liquid to the cooling block is stopped by separating the cooling block from the liquid receiver before the temperature of the liquid in the liquid receiver reaches the lower target temperature.

Preferably, in the first aspect of the present invention, the first temperature of the holder may be equal to the lower target temperature; or higher than the lower target temperature and lower than the higher target temperature; or lower than the lower target temperature and higher than the third temperature. The first temperature of the holder may be set depending on the lower target temperature, environmental temperature, thermal conductivity of the material for the liquid receiver, and the structure and heat dissipation ability of the receiver, such that the temperature of the liquid in the liquid receiver is ultimately kept at the lower target temperature when a sufficient time has elapsed in a state where no heat transfer occurs from the heating block to the liquid receiver or the liquid and no heat transfer from the liquid receiver or the liquid to the cooling block.

Preferably, the heating block is configured to come into contact with a side of the liquid receiver that is opposite from the holder, and the cooling block is configured to come into contact with a side of the liquid receiver that is opposite from the holder.

Preferably, the holder includes a holding surface for holding the liquid receiver and is rotatable about an axis perpendicular to the holding surface. In this case, each of the heating block and the cooling block faces the holding surface of the holder and is movable toward and away from the holding surface.

Preferably, the holding surface includes a first region for holding a liquid receiver containing a liquid in contact with the liquid receiver and a second region for holding a liquid receiver containing a liquid in contact with the liquid receiver. In this case, each of the heating block and the cooling block is configured to move closer to and come into contact with the liquid receiver held in the first region when facing the first region and configured to move closer to and come into contact with the liquid receiver held in the second region when facing the second region.

Preferably, the holding surface includes a first region for holding a plurality of liquid receivers each containing a liquid in contact with the liquid receivers and a second region for holding a plurality of liquid receivers each containing a liquid in contact with the liquid receivers. In this case, each of the heating block and the cooling block is configured to move closer to and come into contact with the plurality of liquid receivers held in the first region when facing the first region and configured to move closer to and come into contact with the plurality of liquid receivers held in the second region when facing the second region.

Preferably, the first region and the second region are configured to hold the plurality of liquid receivers such that the liquid receivers are arranged on a circle (imaginary circle) around the axis.

Preferably, the liquid receiver includes a first cell wall and a second cell wall facing and spaced from each other, and a cell for receiving a liquid defined between the first cell wall and the second cell wall. In this case, the holder is configured to hold the liquid receiver in contact with the first cell wall of the liquid receiver. The heating block is configured to come into contact with the second cell wall of the liquid receiver, and the cooling block is also configured to come into contact with the second cell wall of the liquid receiver.

Preferably, the maximum dimension of the cell in a direction perpendicular to the spacing direction in which the first cell and the second cell are spaced from each other is larger than the maximum dimension of the cell in the spacing direction. That is, it is preferable that the cell for receiving a liquid as the target for temperature control is shallow.

Preferably, each of the heating block and the cooling block includes a projection for coming into contact with the second cell wall. The heating block with a projection for coming into contact with the second cell wall is suitable for allowing local heat transfer from the heating block to the liquid in the cell. The cooling block with a projection for coming into contact with the second cell wall is suitable for allowing local heat transfer from the liquid in the cell to the cooling block. Realizing local heat transfer contributes to enhancement of heat transfer efficiency.

According to a second aspect of the present invention, there is provided a temperature controlling method. The temperature controlling method includes a temperature increase step and a temperature reduction step. In the temperature increase step, a heating block kept at a heating temperature (corresponding to the second temperature in the first aspect) higher than a higher target temperature for a liquid is brought into contact with a liquid receiver containing the liquid to increase the temperature of the liquid. In the temperature reduction step, a cooling block kept at a cooling temperature (corresponding to the third temperature in the first aspect) lower than a lower target temperature that is lower than the higher target temperature is brought into contact with the liquid receiver to reduce the temperature of the liquid. The temperature reduction step is performed with a lower target temperature maintaining member held in contact with the liquid receiver. The lower target temperature maintaining member is kept at any one of a temperature equal to the lower target temperature, a temperature higher than the lower target temperature and lower than the higher target temperature, and a temperature lower than the lower target temperature and higher than the cooling temperature. (The temperature of the lower target temperature maintaining member corresponds to the first temperature in the first aspect.)

The temperature controlling method can be carried out properly by the above-described temperature controlling unit according to the first aspect. The temperature controlling method is suitable for quickly changing (increasing or reducing) the temperature of a liquid and also suitable for controlling the temperature of a liquid precisely to a higher target temperature or a lower target temperature. The temperature controlling method is suitable for the application to e.g. a PCR method that requires quick and precise temperature control.

Preferably, in the second aspect of the present invention, the heating block is separated from the liquid receiver in the temperature increase step when the temperature of the liquid has reached the higher target temperature. This is suitable for controlling the temperature of a liquid during the temperature increase precisely to the higher target temperature in the temperature increase step.

Preferably, in the temperature reduction step, the cooling block is separated from the liquid receiver before the temperature of the liquid reaches the lower target temperature. This contributes to controlling the temperature of a liquid during the temperature reduction precisely to the lower target temperature in the temperature reduction step.

BEST MODE FOR CARRYING OUT THE INVENTION

Figure 1:
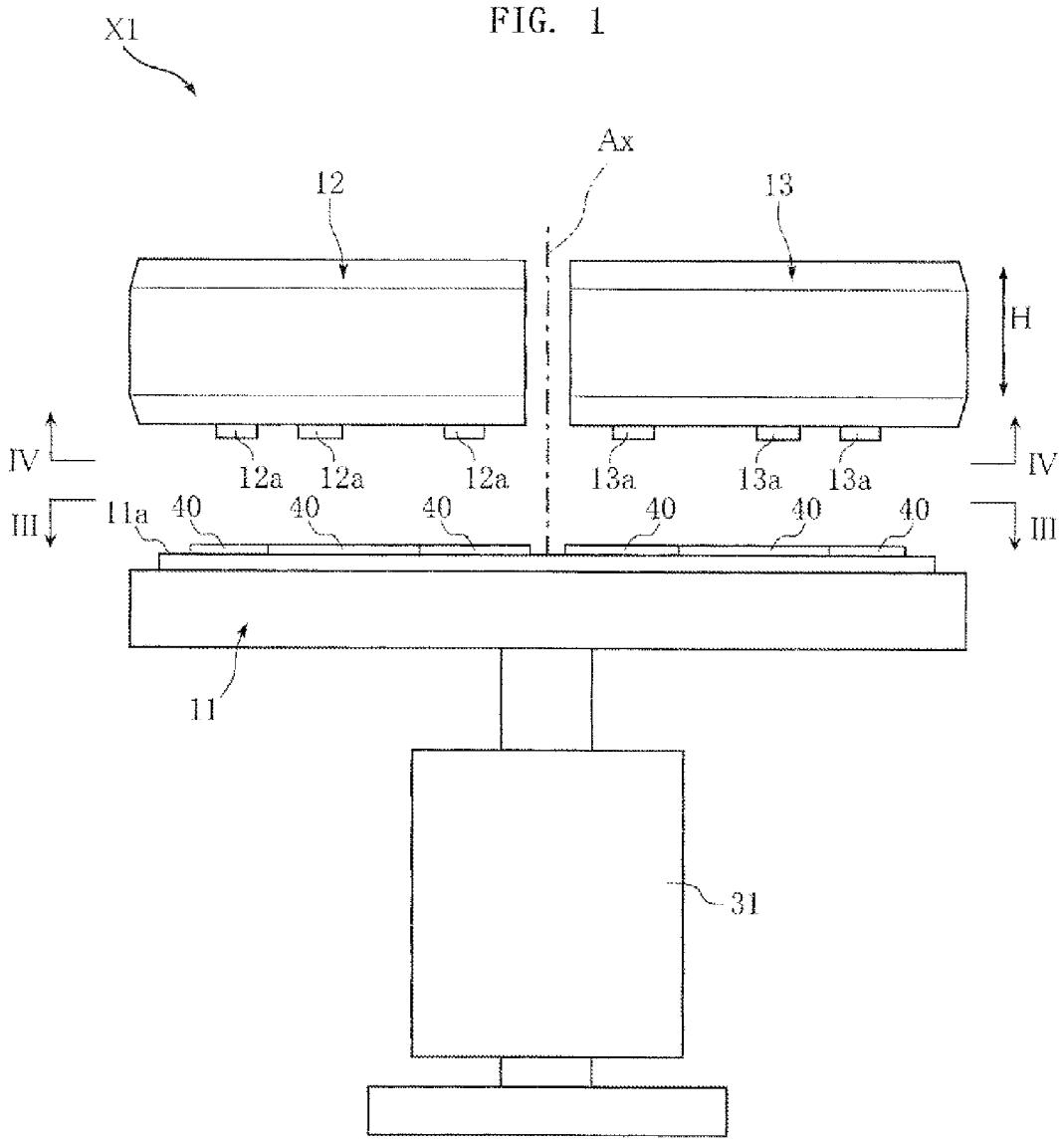
FIG. 1 shows part of the structure of a temperature controlling unit according to the present invention.
Figure 2:
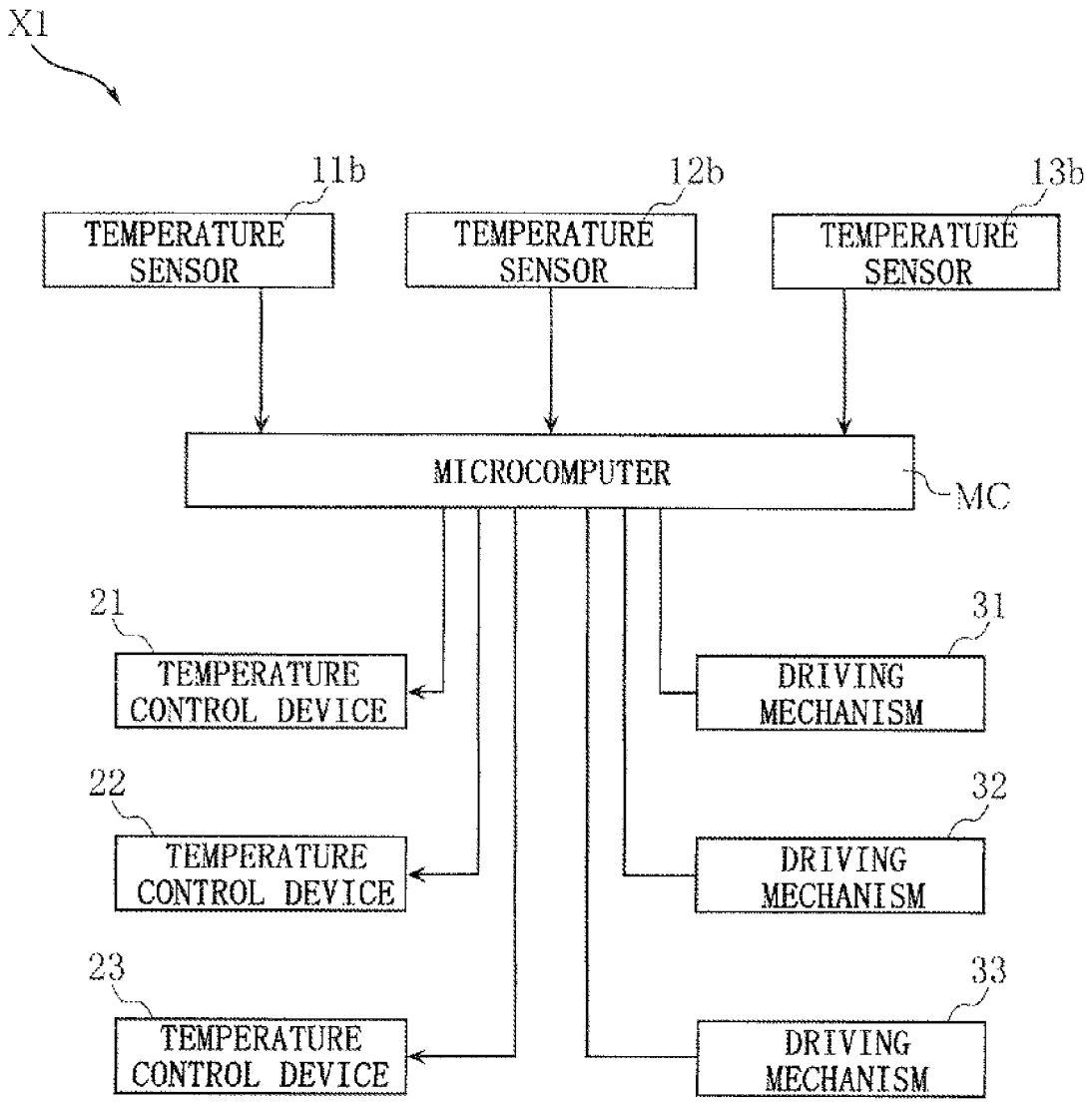
FIG. 2 shows part of a functional block diagram of the temperature controlling unit according to the present invention.
Figure 3:
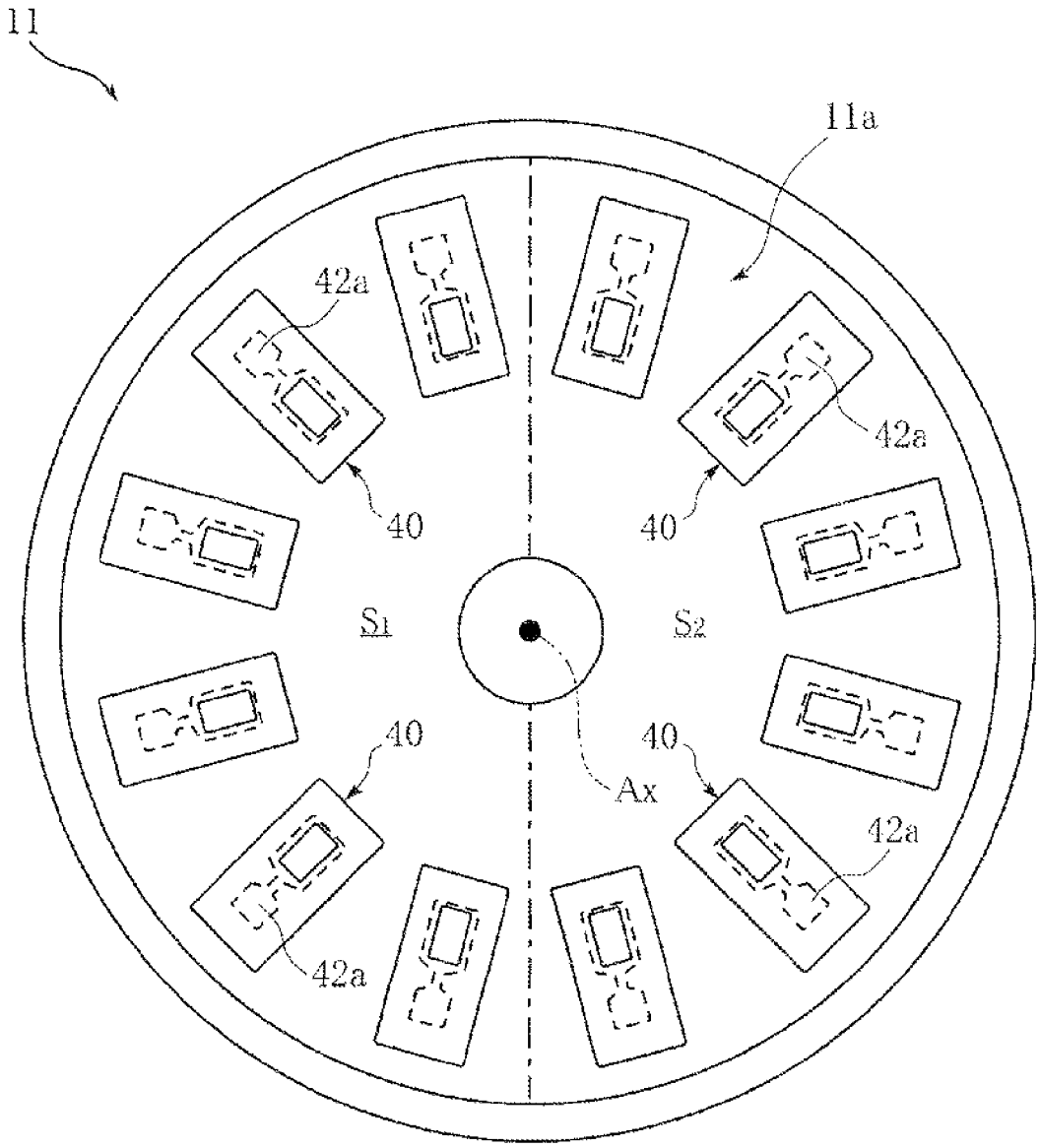
FIG. 3 is a view seen in the direction of arrow in FIG. 1, showing a holding surface of a rotation table, with sample liquid chips held thereon.
Figure 4:
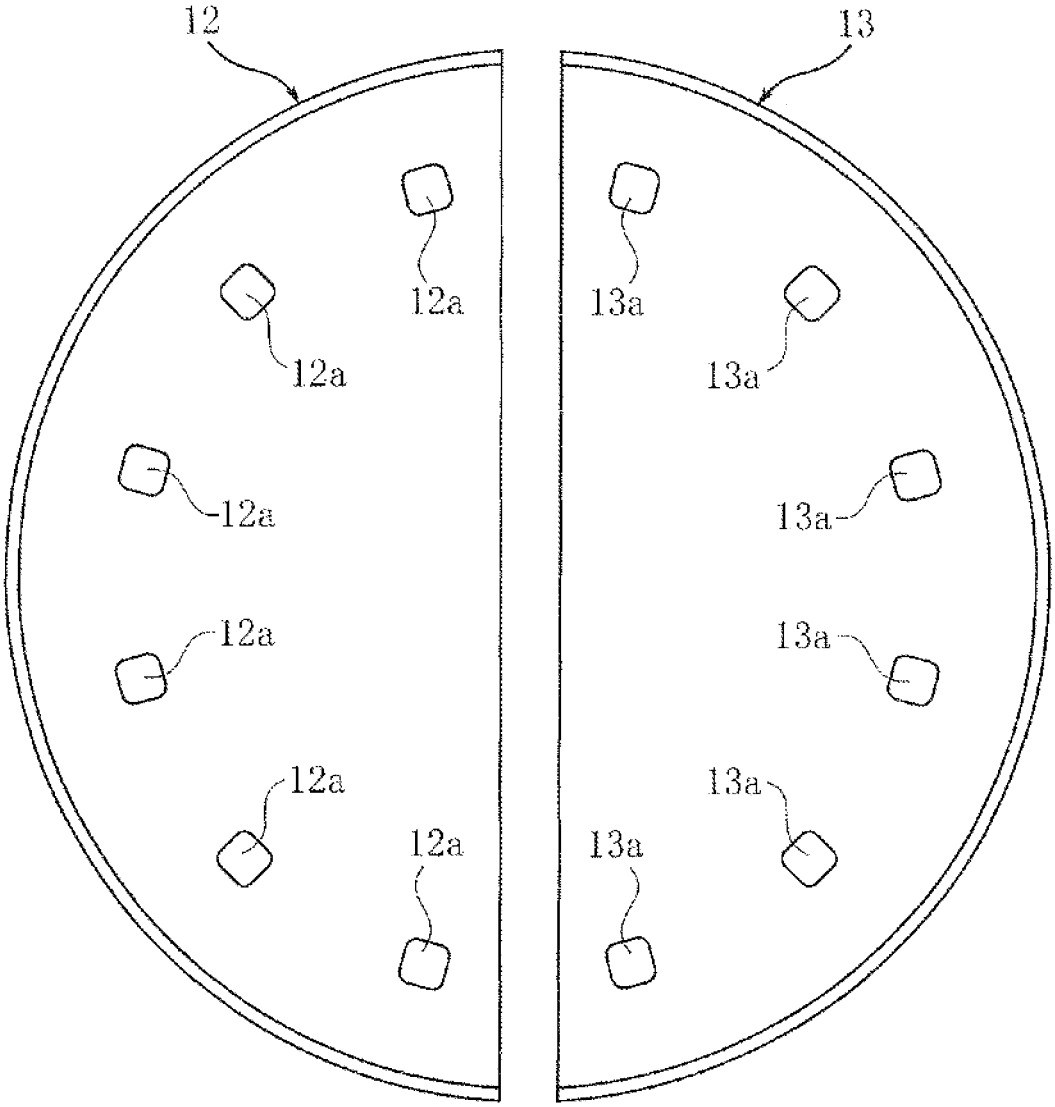
FIG. 4 is a view seen in the direction of arrow IV-IV in FIG. 1, showing a surface of a heating block on the rotation table side and a surface of the cooling block on the rotation table side.

A temperature controlling unit X1 according to the present invention is shown in FIGS. 1-4. FIG. 1 shows part of the structure of the temperature controlling unit X1. FIG. 2 shows part of a functional block diagram of the temperature controlling unit X1. FIGS. 3 and 4 are views seen in the direction of arrows III-III and arrows IV-IV in FIG. 1, respectively.

The temperature controlling unit X1 includes a rotation table 11, a heating block 12, a cooling block 13, temperature controlling devices 21, 22, 23, driving mechanisms 31, 32, 33 and a microcomputer MC. The temperature controlling unit X1 is designed to perform a PCR method that repeats a cycle including thermal denaturation, annealing and elongation a plurality of times.

The rotation table 11 functions as a holder and a lower target temperature maintaining member. The rotation table 11 includes a holding surface 11*a* for holding sample liquid chips 40 in contact with the sample liquid chips 40. The rotation table 11 is rotatable about an axis Ax (perpendicular to the holding surface 11*a*) shown in FIGS. 1 and 3. The holding surface 11*a* includes a first region $S_1$ and a second region $S_2$ each of which includes a plurality of sample liquid chip mount portions. (For clarity, the boundary between the first region $S_1$ and the second region $S_2$ is indicated by a phantom line in FIG. 3.) In this embodiment, the maximum number of sample liquid chips 40 that can be held in the first region $S_1$ and the maximum number of sample liquid chips 40 that can be held in the second region $S_2$ are equal to each other. In this embodiment, the sample liquid chips 40 are held on the holding surface 11*a* as arranged on an imaginary circle around the axis Ax.

Figure 5A:
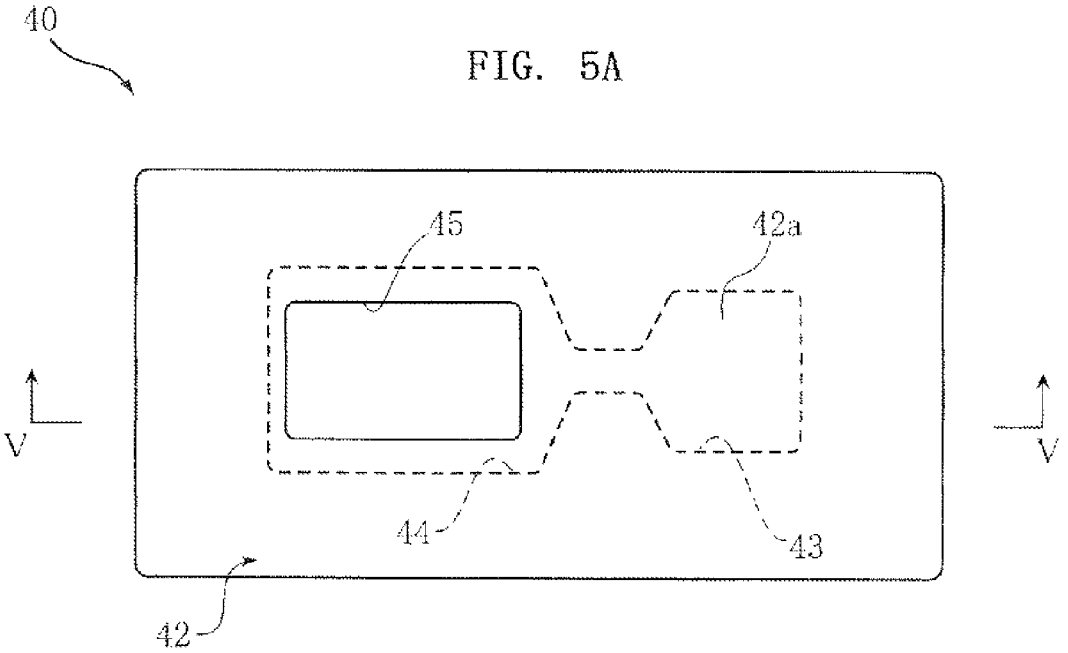
FIG. 5A is an enlarged plan view of a sample liquid chip.
Figure 5B:
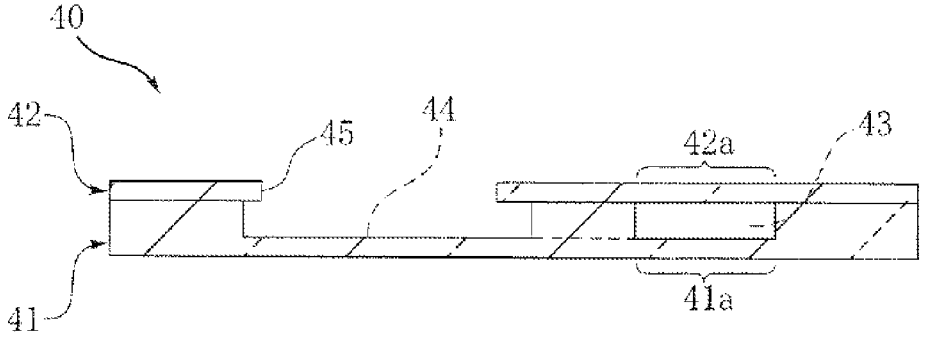
FIG. 5B is a sectional view taken along lines V-V in FIG. 5A.

The specific structure of each sample liquid chip 40 is shown in FIGS. 5A and 5B. FIG. 5A is an enlarged plan view of the sample liquid chip 40. FIG. 5B is a sectional view taken along lines V-V in FIG. 5A. The sample liquid chip 40 is provided by bonding a main body 41 having a recess and a cover 42 having an opening. The sample liquid chip 40 includes a sample liquid cell 43 defined between cell walls 41*a* and 42*a* facing and spaced from each other, a liquid retaining space 44 communicating with the sample liquid cell 43, and an introduction port 45 provided at a position corresponding to the liquid retaining space 44. The main body 41 and the cover 42 can be made by resin molding. Examples of resin material for making the main body 41 and the cover 42 include PS, PC, PMMA, COC and COP. The cell wall 41*a* is part of the main body 41, whereas the cell wall 42*a* is part of the cover 42. The thickness of the cell wall 41*a*, 42*a* (the thickness shown in FIG. 5B) is e.g. 10 to 500 μm. The sample liquid cell 43 is a space for receiving a predetermined sample liquid or the like for performing the PCR method (not shown in FIGS. 5A and 5B). The sample liquid cell 43 is shallow. Specifically, the maximum dimension of the sample liquid cell 43 in a direction perpendicular to the spacing direction of the cell walls 41*a* and 42*a* (e.g. 1000 μm) is larger than the maximum dimension of the sample liquid cell 43 in the spacing direction (e.g. 500 μm). The volume of the sample liquid cell 43 is e.g. 0.1 to 100 μL. A sample liquid containing template DNA, primer DNA, DNA polymerase, and dNTP is introduced into the sample liquid cell 43. The liquid retaining space 44 is a space for preparing the sample liquid to be introduced into the sample liquid cell 43 by mixing various kinds of reagents or the like. The introduction port 45 is used for supplying various kinds of reagents or the like into the liquid retaining space 44.

As shown in FIG. 3, in mounting a sample liquid chip 40 onto the holding surface 11*a* (which is rotatable), the sample liquid chip 40 is arranged in a sample liquid chip mount portion such that the sample liquid cell 43 is positioned on a radially outer side of the holding surface 11*a* and the liquid retaining space 44 is positioned on a radially inner side of the holding surface 11*a*. The sample liquid chip 40 is removably mounted to the holding surface 11*a* of the rotation table 11. Specifically, for instance, a plurality of recesses (now shown) may be formed on a side of the sample liquid chip 40 that is to come into contact with the holding surface 11*a* (i.e., the main body 41 side), whereas a plurality of projections (not shown) for fitting into the recesses may be formed on the holding surface 11*a* in each of the sample liquid chip mount portions at locations corresponding to the recesses. Further, a clipping mechanism for clipping the sample liquid chip 40 onto the holding surface 11*a*, with the above-described projections fitted in the above-described recesses, may be provided at each sample liquid chip mount portion. By employing this structure in the temperature controlling unit X1, each of the sample liquid chips 40 can be removably held at a predetermined position in the holding surface 11*a* of the rotation table 11. When the sample liquid chips 40 are held on the holding surface 11*a* of the rotation table 11, the holding surface 11*a* comes into contact with the main body 41 side (including the cell wall 41*a*) of each sample liquid chip 40.

A temperature sensor 11*b* for detecting the temperature of the holding surface 11*a* is provided on the holding surface 11*a* or inside the rotation table 11 adjacent to the holding surface 11*a*. For instance, the temperature sensor 11*b* comprises a thermistor. As shown in FIG. 2, the temperature sensor 11*b* is connected to the microcomputer MC. Signals outputted from the temperature sensor 11*b* are inputted into the microcomputer MC.

The temperature control device 21 (not shown in FIG. 1) is arranged in the rotation table 11. The temperature control device 21 is thermally connected to the holding surface 11*a* of the rotation table 11. The temperature control device 21 comprises a Peltier module that utilizes Peltier effect. As shown in FIG. 2, the temperature control device 21 is connected to the microcomputer MC. The amount and direction of electric current to be applied to the Peltier module (temperature control device 21) is changed as required in accordance with the instructions from the microcomputer MC. By the operation of the temperature control device 21, the rotation table 11 or at least the holding surface 11*a* of the rotation table is kept at a first temperature $T_1$. The first temperature $T_1$ is a temperature for keeping the sample liquid in the sample liquid chips 40 on the holding surface 11*a* at a lower target temperature $T_L$. The first temperature $T_1$ is set appropriately depending on the lower target temperature $T_L$ for the sample liquid as a target for temperature control, environmental temperature, thermal conductivity of the material for the sample liquid chips 40 and the structure and heat dissipation ability of the sample liquid chips 40, for example. For instance, when the lower target temperature $T_L$ is equal or substantially equal to the environmental temperature, it may be suitable to set the first temperature $T_1$ to be equal to the lower target temperature $T_L$. For instance, when the lower target temperature $T_L$ is considerably higher than the environmental temperature, it may be suitable to set the first temperature $T_1$ to be higher than the lower target temperature $T_L$. For instance, when the lower target temperature $T_L$ is considerably lower than the environmental temperature, it may be suitable to set the first temperature $T_1$ to be lower than the lower target temperature $T_L$.

The driving mechanism 31 drives the rotation table 11 for rotation. The driving mechanism 31 is connected to the microcomputer MC and operates in accordance with the instructions from the microcomputer MC. The driving mechanism 31 outputs the amount of rotation of the rotation table 11 to the microcomputer MC. The rotation table 11 is fixed to the rotation shaft of the driving mechanism 31.

The heating block 12 is designed to come into contact with the sample liquid chips 40 to heat the sample liquid in the sample liquid cells 43 of the sample liquid chips 40. The heating block 12 is movable relative to the sample liquid chips 40 on the holding surface 11*a*. Specifically, the heating block 12 faces the holding surface 11*a* of the rotation table 11 and is movable toward and away from the holding surface 11*a* or the sample liquid chips 40 on the holding surface 11*a* in the arrow H direction shown in FIG. 1. The heating block 12 is kept at a second temperature $T_2$ higher than a higher target temperature $T_H$ (that is higher than the above-described lower target temperature $T_L$) for the sample liquid as a target for temperature control. As shown in FIGS. 1 and 4, the heating block 12 has a plurality of projections 12*a*. Each of the projections 12*a* is arranged to come into contact with the cell wall 42*a* of the sample liquid chip 40 on the holding surface 11*a* (i.e., the side of the sample liquid chip 40 opposite from the rotation table 11).

A temperature sensor 12*b* for detecting the temperature of the heating block 12 is provided in the heating block 12. For instance, the temperature sensor 12*b* comprises a thermistor. As shown in FIG. 2, the temperature sensor 12*b* is connected to the microcomputer MC. Signals outputted from the temperature sensor 12*b* are inputted into the microcomputer MC.

The temperature control device 22 (not shown in FIG. 1) is thermally connected to the heating block 12. The temperature control device 22 is a heater comprising a heating device. The amount of electric current to be applied to the temperature control device 22 is changed as required in accordance with the instructions from the microcomputer MC, whereby the temperature of the temperature control device 22 changes. By the operation of the temperature control device 22, the heating block 12 is kept at the second temperature $T_2$.

The driving mechanism 32 (not shown in FIG. 1) drives the heating block 12 for translation in the arrow H direction shown in FIG. 1. As shown in FIG. 2, the driving mechanism 32 is connected to the microcomputer MC. The driving mechanism 32 operates in accordance with the instructions from the microcomputer MC and outputs the amount of translation of the heating block 12 to the microcomputer MC. By the operation of the driving mechanism 32, the heating block 12 moves toward and away from the holding surface 11*a* of the rotation table 11.

The cooling block 13 is designed to come into contact with the sample liquid chips 40 to cool the sample liquid in the sample liquid cells 43 of the sample liquid chips 40. The cooling block 13 is movable relative to the sample liquid chips 40 on the holding surface 11*a*. Specifically, the cooling block 13 faces the holding surface 11*a* of the rotation table 11 and is movable toward and away from the holding surface 11*a* or the sample liquid chips 40 on the holding surface 11*a*. The cooling block 13 is kept at a third temperature $T_3$ lower than the lower target temperature $T_L$ for the sample liquid as a target for temperature control. The third temperature $T_3$, which is lower than the lower target temperature $T_L$, is lower than the first temperature $T_1$ as well. As shown in FIGS. 1 and 4, the cooling block 13 has a plurality of projections 13*a*. Each of the projections 13*a* is arranged to come into contact with the cell wall 42*a* of the sample liquid chip 40 on the holding surface 11*a* (i.e., the side of the sample liquid chip 40 opposite from the rotation table 11).

A temperature sensor 13*b* for detecting the temperature of the cooling block 13 is provided in the cooling block 13. For instance, the temperature sensor 13*b* comprises a thermistor. As shown in FIG. 2, the temperature sensor 13*b* is connected to the microcomputer MC. Signals outputted from the temperature sensor 13*b* are inputted into the microcomputer MC.

The temperature control device 23 (not shown in FIG. 1) is thermally connected to the cooling block 13. The temperature control device 23 comprises a Peltier module that utilizes Peltier effect. As shown in FIG. 2, the temperature control device 23 is connected to the microcomputer MC. The amount and direction of electric current to be applied to the Peltier module (temperature control device 23) is changed as required in accordance with the instructions from the microcomputer MC. By the operation of the temperature control device 23, the cooling block 13 is kept at the third temperature $T_3$.

The driving mechanism 33 (not shown in FIG. 1) drives the cooling block 13 for translation in the arrow H direction shown in FIG. 1. As shown in FIG. 2, the driving mechanism 33 is connected to the microcomputer MC. The driving mechanism 33 operates in accordance with the instructions from the microcomputer MC and outputs the amount of translation of the cooling block 13 to the microcomputer MC. By the operation of the driving mechanism 33, the cooling block 13 moves toward and away from the holding surface 11*a* of the rotation table 11.

To perform the PCR method in the temperature controlling unit X1, sample liquid chips 40 are mounted on the holding surface 11*a* of the rotation table 11 and then sample liquid is introduced into the sample liquid chips 40 in the following manner, for example.

Figure 6A:
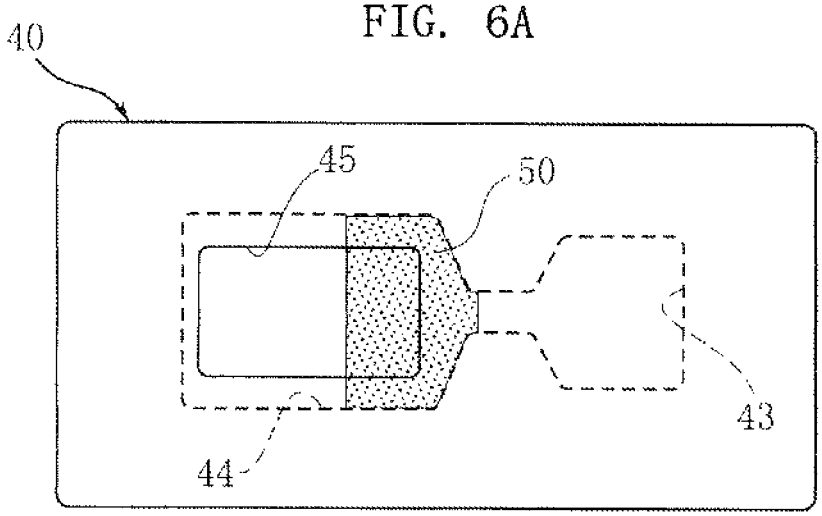
FIG. 6A shows a process in introducing sample liquid into a sample liquid chip.
Figure 6B:
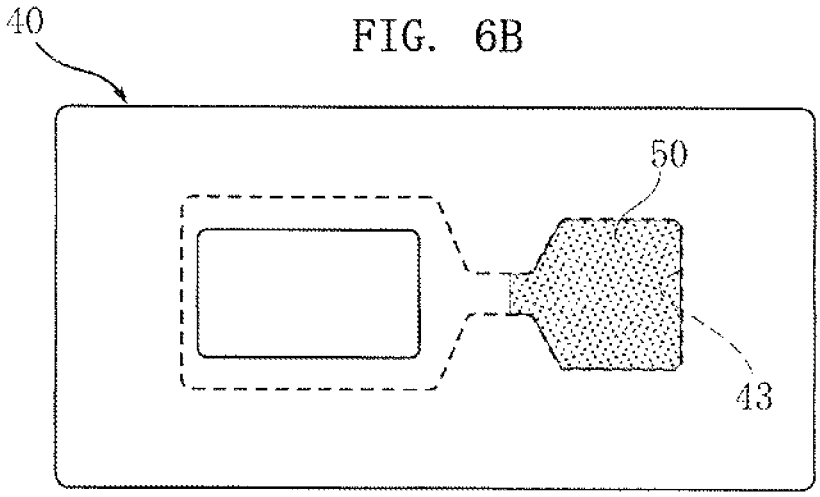
FIG. 6B shows a process in introducing sample liquid into a sample liquid chip.
Figure 6C:
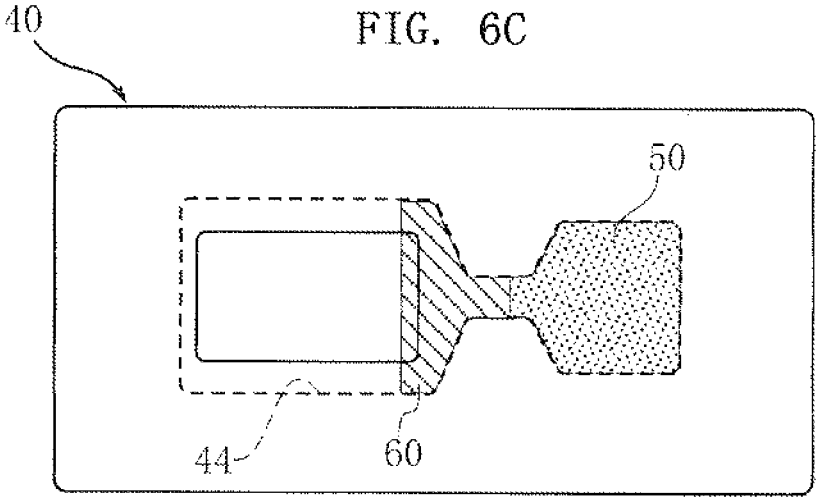
FIG. 6C shows a process in introducing sample liquid into a sample liquid chip.

First, as shown in FIG. 3, for example, a necessary number of sample liquid chips 40 are set on the sample liquid chip mount portions in the holding surface 11*a* of the rotation table 11. (As described above, in this process, each of the sample liquid chips 40 is arranged such that the sample liquid cell 43 is positioned on a radially outer side of the holding surface 11*a* and the liquid retaining space 44 is positioned on a radially inner side of the holding surface.) The position of each of the sample liquid chips 40 on the holding surface 11*a* is fixed during the subsequent steps. Then, as shown in FIG. 6A, necessary reagents or the like are introduced into the liquid retaining space 44 through the introduction port 45. Specifically, for example, each reagent may be prepared in the form of a solution and supplied into the liquid retaining space 44. Alternatively, part of the reagents may be prepared in the form of a dried reagent and applied in advance to the bottom surface of the liquid retaining space 44. In this case, other reagents each prepared as a solution are then supplied into the liquid retaining space 44 so that the dried reagent dissolves into the reagents in the form of a solution. Examples of necessary reagents or the like include template DNA, primer DNA, DNA polymerase, dNTP and a buffer component. The reagents are mixed within the liquid retaining space 44 by e.g. pipetting, whereby a sample liquid 50 as a homogenous reaction liquid is obtained. Then, the rotation table 11 is rotated about the axis Ax at a predetermined speed. The centrifugal force acting on the sample liquid 50 due to the rotation of the rotation table 11 causes the sample liquid 50 to move into the sample liquid cell 43, as shown in FIG. 6B. Then, as shown in FIG. 6C, mineral oil 60 is supplied into the liquid retaining space 44. The presence of mineral oil 60 prevents the sample liquid 50 from being lost by evaporation, for example, in the subsequent temperature change process.

Then, the rotation table 11 is fixed at a predetermined rotational position about the axis Ax. Specifically, by the operation of the driving mechanism 31, the position of the rotation table 11 is fixed such that the first region $S_1$ of the holding surface 11*a* faces the heating block 12 whereas the second region $S_2$ of the holding surface 11*a* faces the cooling block 13.

Then, each of the rotation table 11, the heating block 12 and the cooling block 13 is set to a desired temperature and kept at the desired temperature. Specifically, this process is performed in the following manner. The temperature of the rotation table 11 at least at the holding surface 11*a* is adjusted to the above-described first temperature $T_1$ by the operation of the temperature control device 21, and the first temperature $T_1$ is maintained. The temperature of the heating block 12 is adjusted to the above-described second temperature $T_2$ (heating temperature) by the operation of the temperature control device 22, and the second temperature $T_2$ is maintained. The temperature of the cooling block 13 is adjusted to the above-described third temperature $T_3$ (cooling temperature) by the operation of the temperature control device 23, and the third temperature $T_3$ is maintained. The lower target temperature which the sample liquid 50 should reach in the PCR process is expressed as $T_L$ (e.g. 60° C.), whereas the higher target temperature which the sample liquid should reach in the PCR process is expressed as $T_H$ (e.g. 95° C.). In such a case, the first temperature $T_1$ is a temperature by which the temperature of the sample liquid 50 can be kept at the lower target temperature $T_L$ when a sufficient time has elapsed in a state where no heat transfer occurs from the heating block 12 to the sample liquid 50 and no heat transfer from the sample liquid 50 to the cooling block 13. Specifically, the first temperature $T_1$ may be a temperature equal to the lower target temperature $T_L$, or a temperature higher than the lower target temperature $T_L$ and lower than the higher target temperature $T_H$, or a temperature lower than the lower target temperature $T_L$ and higher than the third temperature $T_3$ (cooling temperature). The second temperature $T_2$ is a temperature higher than the higher target temperature $T_H$. The third temperature $T_3$ is a temperature lower than the lower target temperature $T_L$.

Figure 7:
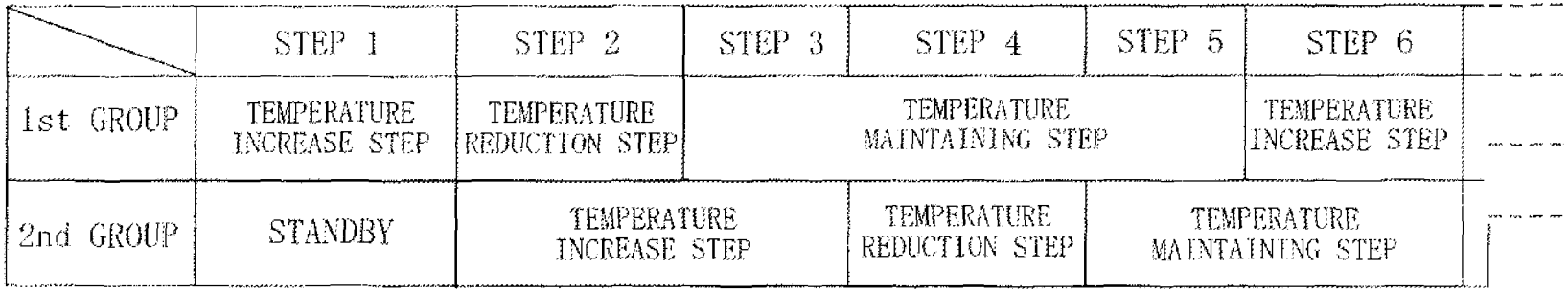
FIG. 7 shows part of a table of steps in parallel temperature control performed by the temperature controlling unit according to the present invention.

In the temperature controlling unit X1, after the preparation as described above is completed and the temperature of the sample liquid 50 has reached the lower target temperature $T_L$, the PCR method or temperature control is performed in a parallel manner. In this parallel PCR method, the temperature increase step, the temperature reduction step and the temperature maintaining step are performed with respect to the sample liquid 50 in the sample liquid chips 40 held in the first region $S_1$ (constituting the first group) of the holding surface 11*a*, while at the same time, the temperature increase step, the temperature reduction step and the temperature maintaining step are performed with respect to the sample liquid 50 in the sample liquid chips 40 held in the second region $S_2$ (constituting the second group) of the holding surface 11*a*. FIG. 7 shows part of a table of steps in the temperature control performed by the temperature controlling unit X1.

Figure 8:
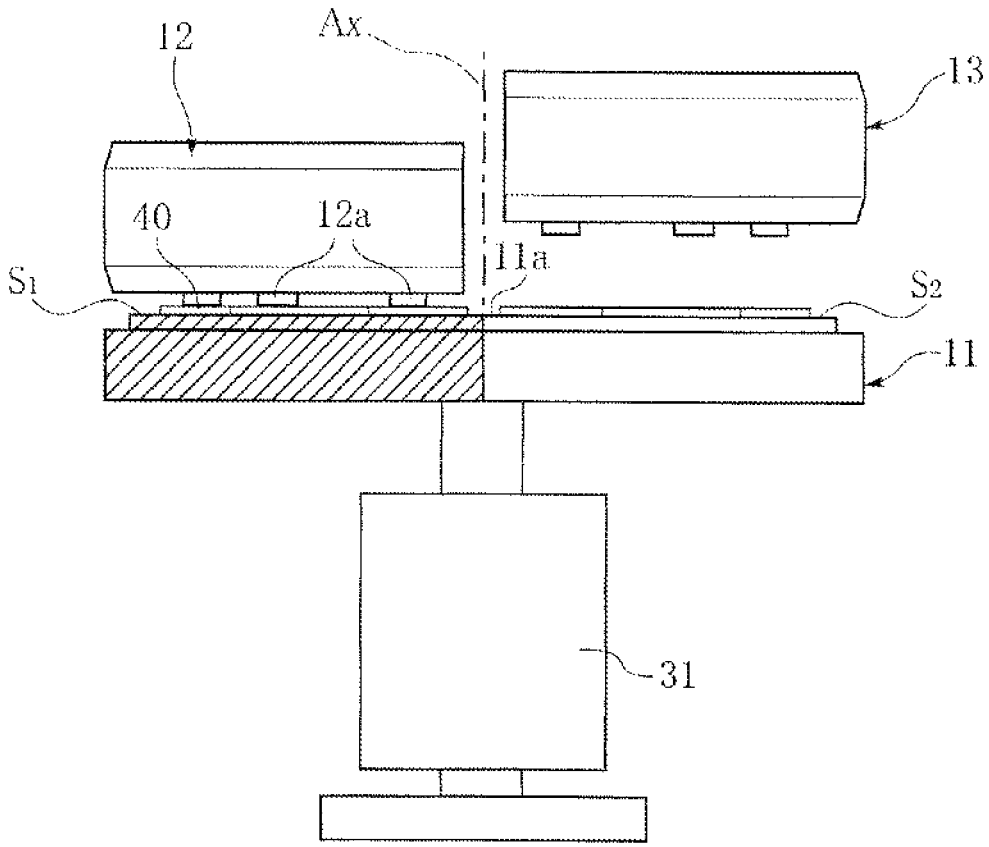
FIG. 8 shows the state of the temperature controlling unit in Steps 1 and 6.

First, in the parallel PCR method by the temperature controlling unit X1, the temperature increase step is performed in Step 1 with respect to the sample liquid chips 40 held in the first region $S_1$, as shown in FIG. 8. (For clarity, the first region $S_1$ side of the rotation table 11 is hatched in FIG. 8 and FIGS. 9-12 as well.)

Figure 13:
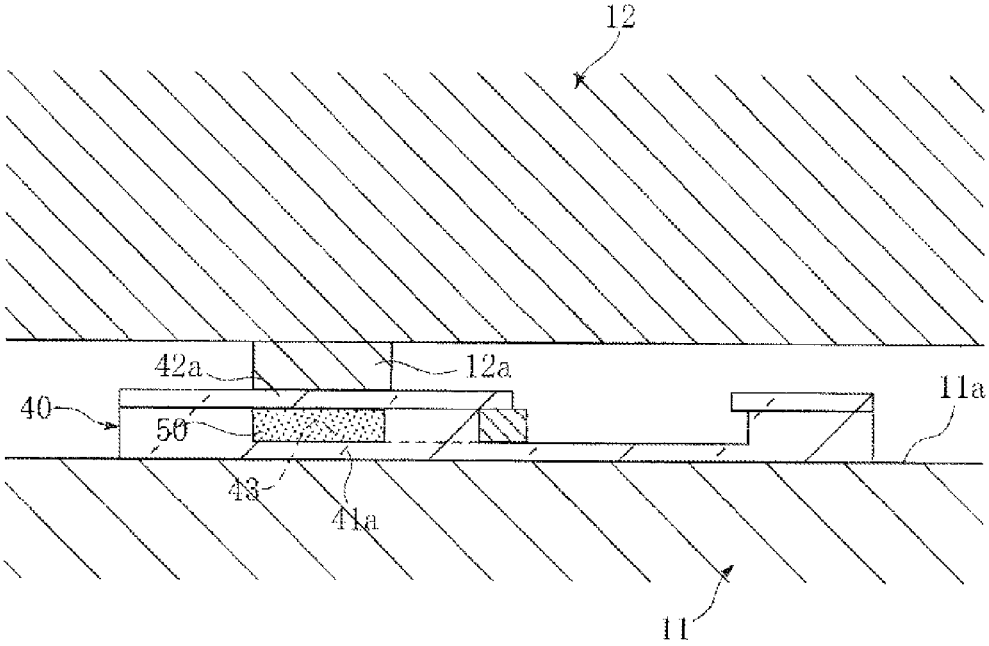
FIG. 13 is an enlarged sectional view showing part of the temperature controlling unit during a temperature increase step.

Specifically, in Step 1, the heating block 12 is moved closer to the rotation table 11 to come into contact with the sample liquid chips 40 in the first region $S_1$ of the holding surface 11*a* by the operation of the driving mechanism 32, as shown in FIG. 8. More specifically, as shown in FIG. 13, each projection 12*a* of the heating block 12 is brought into contact with the cell wall 42*a* of the corresponding sample liquid chip 40. (The cell wall 42*a*, along with the cell wall 41*a*, defines the sample liquid cell 43.) By this contact, the temperature increase step with respect to the sample liquid chips 40 of the first group is started. In this temperature increase step, the cell wall 42*a* of the sample liquid chip 40 is directly heated by the heating block 12 or the projection 12*a*. By heating the cell wall 42*a*, heat transfers from the heating block 12 or the projection 12*a* to the cell wall 42*a* and the sample liquid 50 in the sample liquid cell 43. Thus, the temperature of the sample liquid 50 increases and reaches the higher target temperature $T_H$. As a result, the two strands of a template DNA in the sample liquid 50 are sufficiently separated from each other (the thermal denaturation step of the first group). When the sample liquid 50 reaches the higher target temperature $T_H$, the heating block 12 or the projection 12*a* is separated from the cell wall 42*a* of the sample liquid chip 40. Thus, heat transfer from the heating block 12 to the sample liquid 50 stops (end of the temperature increase step of the first group).

In Step 1, on the other hand, the sample liquid 50 in the sample liquid chips 40 in the second region $S_2$ (the second group) are kept at a constant temperature (lower target temperature $T_L$) and in a standby state. Any reaction related to PCR does not occur in the sample liquid 50 in these sample liquid chips 40 of the second group.

When Step 1 is finished, the heating block 12 is separated from the sample liquid chips 40 of the first group as described above, and at the same time, the rotation table 11 is rotated 180° about the axis Ax by the operation of the driving mechanism 31. Due to this rotation, the position of the sample liquid chips 40 in the first region $S_1$ that belong to the first group switches with the position of the sample liquid chips 40 in the second region $S_2$ that belong to the second group.

Figure 9:
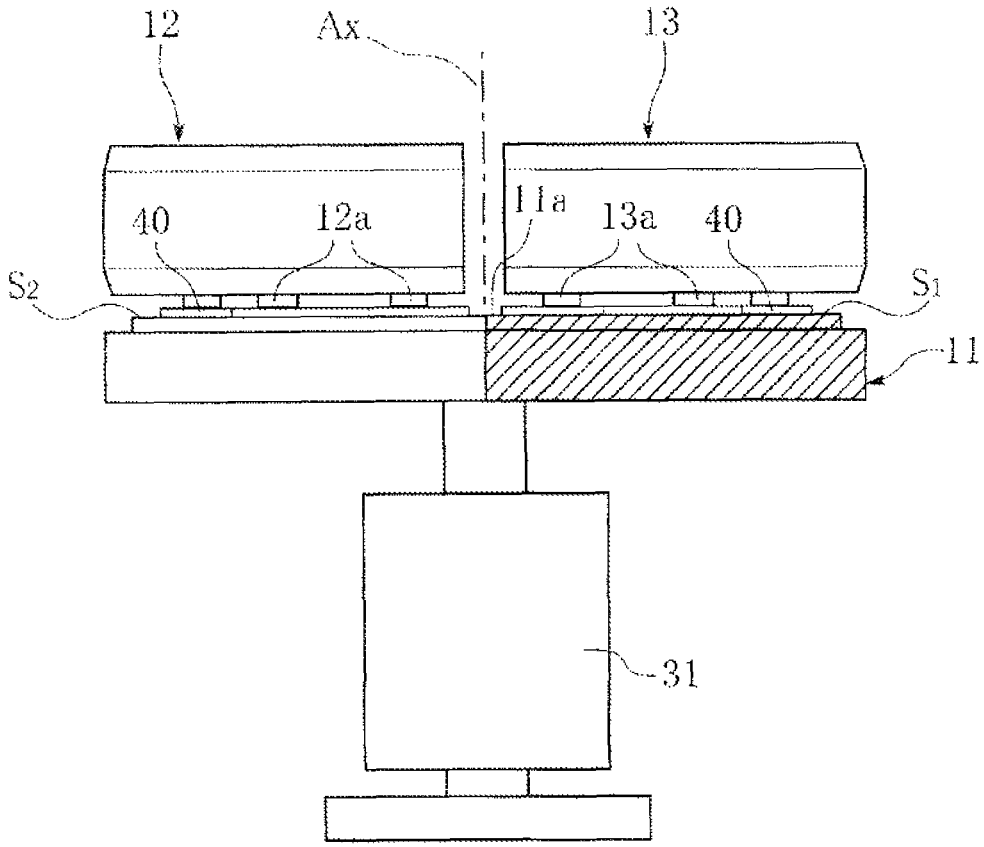
FIG. 9 shows the state of the temperature controlling unit in Step 2.

Next, in Step 2, the temperature reduction step is performed with respect to first group, whereas the temperature increase step is performed with respect to the second group, as shown in FIG. 9.

Figure 14:
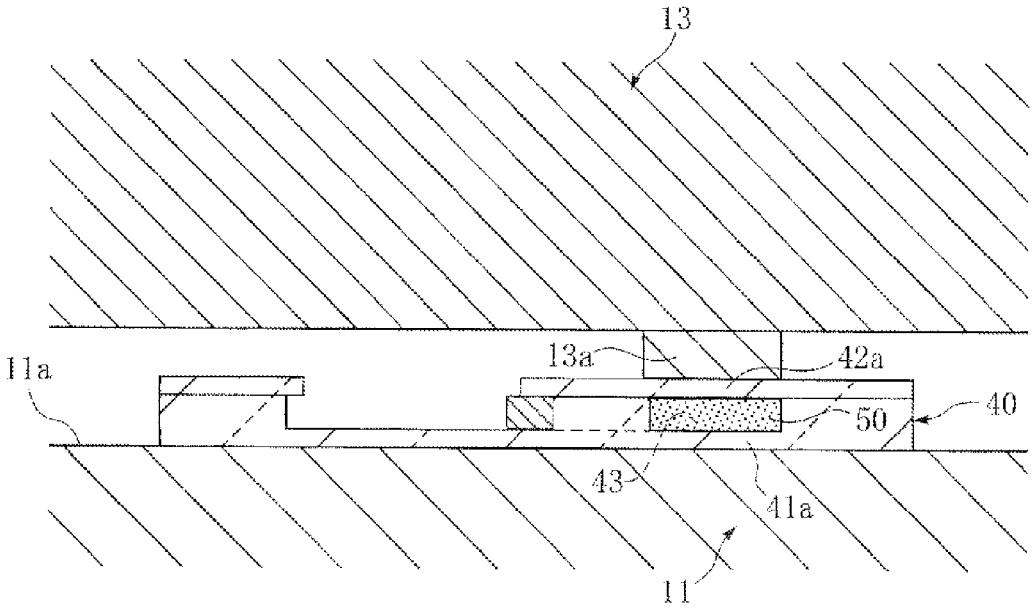
FIG. 14 is an enlarged sectional view showing part of the temperature controlling unit during a temperature reduction step.

Specifically, in Step 2, the cooling block 13 is moved closer to the rotation table 11 to come into contact with the sample liquid chips 40 in the first region $S_1$ of the holding surface 11*a* by the operation of the driving mechanism 33, as shown in FIG. 9. More specifically, as shown in FIG. 14, each projection 13*a* of the cooling block 13 is brought into contact with the cell wall 42*a* of the corresponding sample liquid chip 40. (The cell wall 42*a*, along with the cell wall 41*a*, defines the sample liquid cell 43.) By this contact, the temperature reduction step with respect to the sample liquid chips 40 of the first group is started. In this temperature reduction step, the cell wall 42*a* of the sample liquid chip 40 is directly cooled by the cooling block 13 or the projection 13*a*. Heat transfers from the cell wall 42*a* and the sample liquid 50 in the sample liquid cell 43 to the cooling block 13 or the projection 13*a*. Thus, the temperature of the sample liquid 50 reduces. During the temperature reduction, annealing gradually proceeds within the sample liquid 50 (part of the annealing step of the first group). In this annealing step, each single-stranded DNA of the template combines with a primer (containing a base sequence complementary to part of the single-stranded DNA). The cooling block 13 or the projection 13*a* is separated from the cell wall 42*a* of the sample liquid chip 40 by the operation of the driving mechanism 33 immediately before (e.g. 10 to 1000 milliseconds before) the sample liquid 50 reaches the lower target temperature $T_L$. Thus, heat transfer to the cooling block 13 stops (end of the temperature reduction step of the first group; end of Step 2).

In Step 2, on the other hand, the heating block 12 is moved closer to the rotation table 11 to come into contact with the sample liquid chips 40 in the second region $S_2$ of the holding surface 11*a* by the operation of the driving mechanism 32, as shown in FIG. 9. More specifically, as shown in FIG. 13, each projection 12*a* of the heating block 12 is brought into contact with the cell wall 42*a* of the corresponding sample liquid chip 40. By this contact, the temperature increase step with respect to the sample liquid chips 40 of the second group is started. In this temperature increase step, the cell wall 42*a* of the sample liquid chip 40 is directly heated by the heating block 12 or the projection 12*a*. Heat transfers from the heating block 12 or the projection 12*a* to the cell wall 42*a* and the sample liquid 50 in the sample liquid cell 43. Thus, the temperature of the sample liquid 50 increases.

Figure 10:
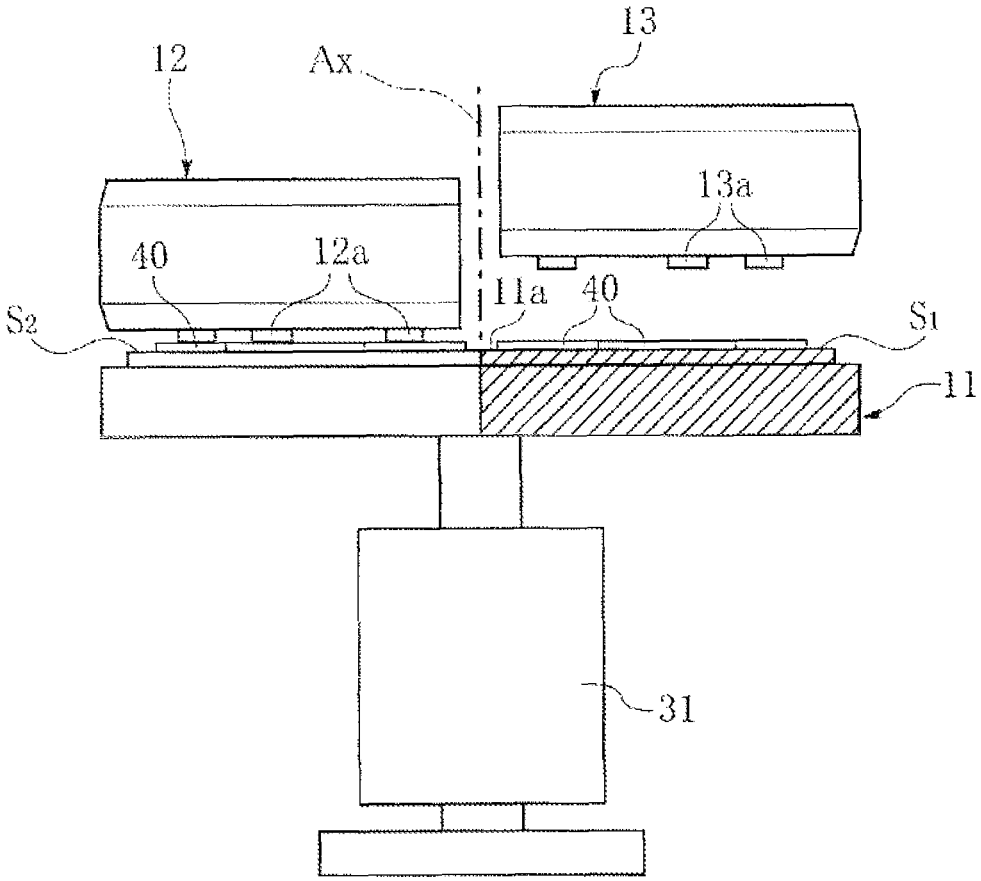
FIG. 10 shows the state of the temperature controlling unit in Step 3.

Next, in Step 3, the temperature maintaining step is performed with respect to the first group, whereas the temperature increase step is performed continuously from Step 2 with respect to the second group, as shown in FIG. 10.

In Step 3, the sample liquid chips 40 of the first group are left in contact with the holding surface 11*a* and the sample liquid 50 in each of the sample liquid chips 40 is kept at a constant temperature (the lower target temperature $T_L$) (the temperature maintaining step of the first group). In the sample liquid 50 in this state, annealing (part of the annealing step of the first group) and elongation (part of the elongation step of the first group) proceed at the same time. In the annealing step, as described above, each single-stranded DNA of the template combines with a primer (containing a base sequence complementary to part of the single-stranded DNA). In the elongation step, at the 3' end of the primer combined with the single-stranded DNA of the template, a DNA strand containing base sequence complementary to single-stranded DNA is elongated or synthesized.

In Step 3, continuously from Step 2, the cell wall 42*a* of each sample liquid chip 40 of the second group is directly heated by the heating block 12 or the projection 12*a*, and heat transfers from the heating block 12 or the projection 12*a* to the cell wall 42*a* and the sample liquid 50 in the sample liquid cell 43. When the sample liquid 50 reaches the higher target temperature $T_H$, the two strands of a template DNA in the sample liquid 50 are sufficiently separated from each other (thermal denaturation step of the second group). When the sample liquid 50 reaches the higher target temperature $T_H$, the heating block 12 or the projection 12*a* is separated from the cell wall 42*a* of the sample liquid chip 40 by the operation of the driving mechanism 32. Thus, heat transfer from the heating block 12 to the sample liquid 50 stops (end of the temperature increase step of the first group).

When Step 3 is finished, the heating block 12 is separated from the sample liquid chips 40 of the second group as described above, and at the same time, the rotation table 11 is rotated 180° about the axis Ax by the operation of the driving mechanism 31. Due to this rotation, the position of the sample liquid chips 40 in the first region $S_1$ that belong to the first group switches with the position of the sample liquid chips 40 in the second region $S_2$ that belong to the second group.

Figure 11:
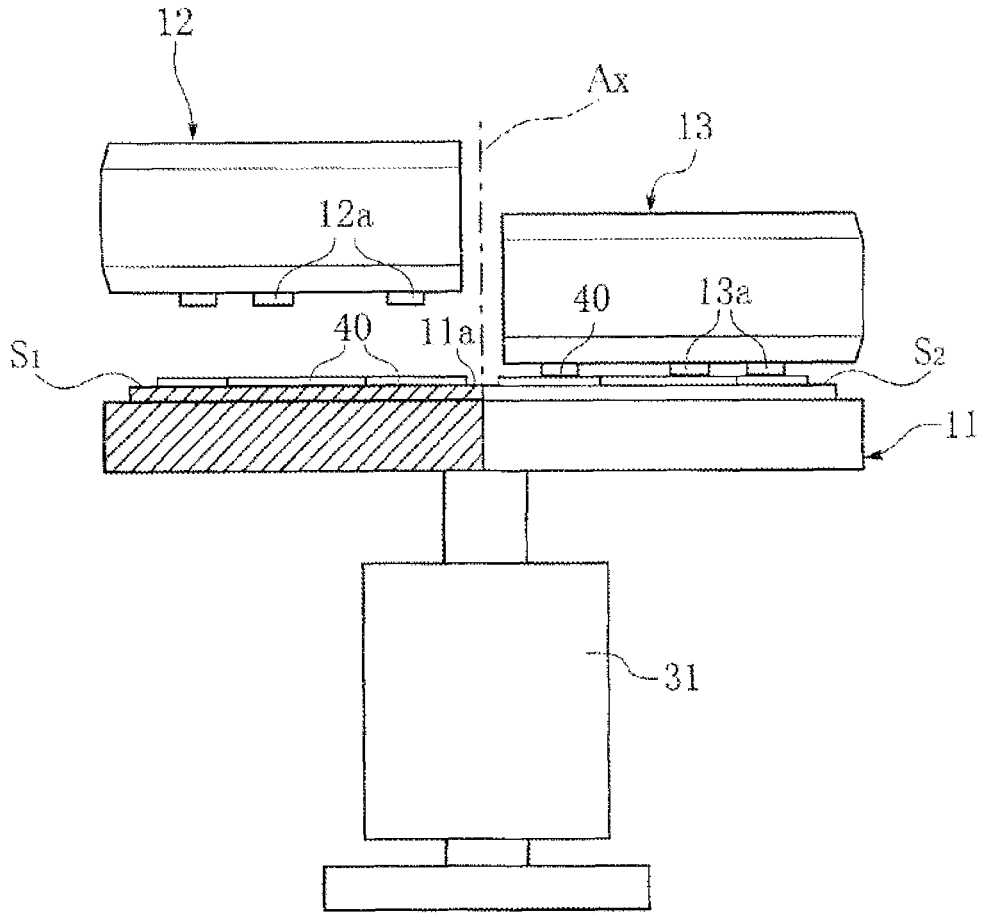
FIG. 11 shows the state of the temperature controlling unit in Step 4.

Next, in Step 4, the temperature maintaining step is performed continuously from Step 3 with respect to the first group, whereas the temperature reduction step is performed with respect to the second group, as shown in FIG. 11.

In Step 4, continuously from Step 3, the sample liquid chips 40 of the first group are left in contact with the holding surface 11*a* and the sample liquid 50 in the sample liquid cell 43 of each of the sample liquid chips 40 is kept at a constant temperature (the lower target temperature $T_L$). Thus, in the sample liquid 50 of the first group, continuously from Step 3, annealing (part of the annealing step of the first group) and elongation (part of the elongation step of the first group) proceed at the same time.

In Step 4, the cooling block 13 is moved closer to the rotation table 11 to come into contact with the sample liquid chips 40 in the second region $S_2$ of the holding surface 11*a* by the operation of the driving mechanism 33, as shown in FIG. 11. More specifically, as shown in FIG. 14, each projection 13*a* of the cooling block 13 is brought into contact with the cell wall 42*a* of the corresponding sample liquid chip 40. By this contact, the temperature reduction step with respect to the sample liquid chips 40 of the second group is started. In this temperature reduction step, the cell wall 42*a* of the sample liquid chip 40 is directly cooled by the cooling block 13 or the projection 13*a*. Heat transfers from the cell wall 42*a* and the sample liquid 50 in the sample liquid cell 43 to the cooling block 13 or the projection 13*a*. Thus, the temperature of the sample liquid 50 reduces. During the temperature reduction, annealing gradually proceeds within the sample liquid 50 (part of the annealing process of the second group). The cooling block 13 or the projection 13*a* is separated from the cell wall 42*a* of the sample liquid chip 40 by the operation of the driving mechanism 33 immediately before (e.g. 10 to 1000 milliseconds before) the sample liquid 50 reaches the lower target temperature $T_L$. Thus, the heat transfer to the cooling block 13 stops (end of the temperature reduction step of the second group; end of Step 4).

Figure 12:
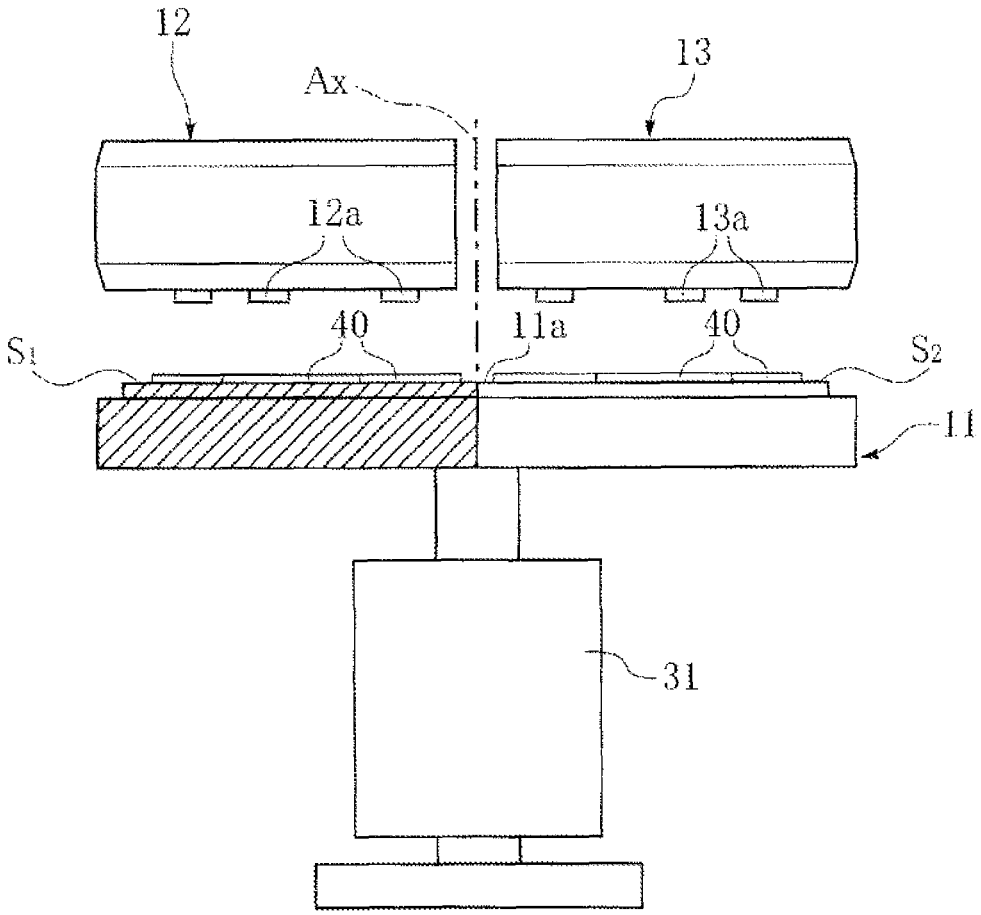
FIG. 12 shows the state of the temperature controlling unit in Step 5.

Next, in Step 5, the temperature maintaining step is performed continuously from Step 4 with respect to the first group, and the temperature maintaining step is performed with respect to the second group as well, as shown in FIG. 12.

In Step 5, continuously from Step 4, the sample liquid chips 40 of the first group are left in contact with the holding surface 11*a* and the sample liquid 50 in the sample liquid cell 43 of each of the sample liquid chips 40 is kept at a constant temperature (the lower target temperature $T_L$). Thus, in the sample liquid 50 of the first group, continuously from Step 4, annealing (part of the annealing step of the first group) and elongation (part of the elongation step of the first group) proceed at the same time.

In Step 5, the sample liquid chips 40 of the second group are left in contact with the holding surface 11*a* and the sample liquid 50 in the sample liquid cell 43 of each of the sample liquid chips 40 is kept at a constant temperature (the lower target temperature $T_L$) (the temperature maintaining step of the second group). Thus, in the sample liquid 50, annealing (part of the annealing step of the second group) and elongation (part of the elongation step of the second group) proceed at the same time.

Next, in Step 6, the temperature increase step (of the second cycle) is performed with respect to the first group, whereas the temperature maintaining step is performed continuously from Step 5 with respect to the second group, as shown in FIG. 8.

In Step 6, the temperature increase step is performed with respect to the sample liquid chips 40 of the first group in the first region $S_1$, similarly to the temperature increase step described above with respect to Step 1. Meanwhile, the sample liquid chips 40 of the second group in the second region $S_2$ are left in contact with the holding surface 11*a* and the sample liquid 50 in the sample liquid cell 43 of each of the sample liquid chips 40 is kept at a constant temperature (the lower target temperature $T_L$). Thus, in the sample liquid 50 of the second group, annealing (part of the annealing step of the second group) and elongation (part of the elongation step of the second group) proceed at the same time, continuously from Step 5. The temperature maintaining step of the second group is completed when Step 6 is finished.

When Step 6 is finished, the heating block 12 is separated from the sample liquid chips 40 of the first group in the first region $S_1$, and at the same time, the rotation table 11 is rotated 180° about the axis Ax by the operation of the driving mechanism 31. Due to this rotation, the position of the sample liquid chips 40 in the first region $S_1$ that belong to the first group switches with the position of the sample liquid chips 40 in the second region $S_2$ that belong to the second group.

As to Steps 1-6 described above, the temperature increase step of the first group in Step 1 is performed for e.g. six seconds, the temperature reduction step of the first group in Step 2 is performed for e.g. four seconds, and the temperature maintaining step of the first group through Steps 3-5 is performed for e.g. 16 seconds. (The temperature increase step of the first group in Step 6 is performed for the same period of time as that in Step 1.) The temperature increase step of the second group through Steps 2-3 is performed for e.g. six seconds, the temperature reduction step of the second group in Step 4 is performed for e.g. four seconds, and the temperature maintaining step of the second group through Steps 5-6 is performed for e.g. 16 seconds.

In the temperature controlling unit X1, a thermal cycle consisting of the above-described Steps 1-5 is performed repetitively with respect to the sample liquid 50 in the sample liquid cells 43 of the sample liquid chips 40 in the first region $S_1$ (first group). Thus, the PCR method that repeats a cycle including thermal denaturation, annealing and elongation a predetermined number of times can be performed. In parallel with this, in the temperature controlling unit X1, a thermal cycle consisting of the above-described Steps 2-6 is performed repetitively with respect to the sample liquid 50 in the sample liquid cells 43 of the sample liquid chips 40 in the second region $S_2$ (second group). Thus, the PCR method that repeats a cycle including thermal denaturation, annealing and elongation a predetermined number of times can be performed also with respect to the sample liquid 50 in the sample liquid cells 43 of the sample liquid chips 40 of the second group. In this way, in the temperature controlling unit X1, the PCR method or the temperature control is performed in a parallel manner.

The temperature controlling unit X1 that operates as described above is suitable for quickly changing the temperature of the sample liquid. The reason is as follows.

The temperature controlling unit X1 is designed such that the heating block 12 can come into direct contact with the cell wall 42*a* of the sample liquid cell 43 to increase the temperature of the sample liquid 50. Thus, in the temperature increase step, the heating block 12 heats the sample liquid 50 in direct contact with the cell wall 42*a*. In the above-described conventional PCR machine X2, for example, the heating block 92 needs to heat the tube 94 or the reaction sample liquid in the tube via the holding block 91 (heat capacity member) that holds the tube 94, and the holding block 91 has a large heat capacity. Thus, in the PCR machine X2, to increase the temperature of the reaction sample liquid in the tube 94 to the higher target temperature, it is necessary to increase the temperature of the holding block 91 as well, which has a large heat capacity, to the higher target temperature. Thus, the holding block 91 (heat capacity member) tends to hinder quick temperature increase of the reaction sample liquid. In the temperature increase step by the temperature controlling unit X1, on the other hand, it is not necessary to heat the sample liquid chip 40 or the sample liquid 50 via a heat capacity member for holding the sample liquid chip 40. Thus, the temperature controlling unit X1, in which no member having a large heat capacity intervenes between the heating block 12 and the sample liquid chip 40 or the sample liquid 50, is suitable for quickly increasing the temperature of the sample liquid 50 in the sample liquid cell 43.

With respect to the temperature controlling unit X1, it is supposed that the temperature of the sample liquid 50 in the sample liquid cell 43 during the temperature increase step is represented by T, the amount of heat supplied to the sample liquid 50 is represented by Q, and time is represented by t. Now, the increasing rate of the temperature, i.e., the temperature increase speed of the sample liquid 50 in the temperature increase step (dT/dt) is proportional to the amount of heat supplied to the sample liquid 50 per unit time (dQ/dt). The amount of heat supplied to the sample liquid 50 per unit time (dQ/dt) is highly related to the temperature difference ($T_2$−T) between the sample liquid 50 and the heating block 12 (kept at a second temperature $T_2$ higher than the higher target temperature $T_H$) and is substantially proportional to the temperature difference ($T_2$−T). A larger temperature difference ($T_2$−T) leads to a larger amount of heat supply to the sample liquid 50 per unit time (dQ/dt) and also to a higher temperature increase speed (dT/dt). In the conventional PCR machine X2, the temperature of the heating block 92 is kept at the thermal denaturation temperature $T_{11}$ that is the higher target temperature of the reaction sample liquid, and thus the difference from the temperature T of the reaction sample liquid during the temperature increase step is ($T_{11}$−T). As will be understood by comparing the temperature controlling unit X1 and the conventional PCR machine X2 on the assumption that the higher target temperatures are equal (i.e., $T_H$=$T_{11}$), the temperature difference ($T_2$−T) between the sample liquid 50 and the heating block 12 in the temperature controlling unit X1 can be larger than the temperature difference ($T_{11}$−T) between the reaction sample liquid and the heating block 92 in the PCR machine X2 ($T_2$>$T_H$=$T_{11}$). As noted before, a larger temperature difference ($T_2$−T) leads to a larger amount of heat supply to the sample liquid 50 per unit time (dQ/dt). Accordingly, the temperature increase speed (dT/dt) of the sample liquid 50 is high.

Figure 20:
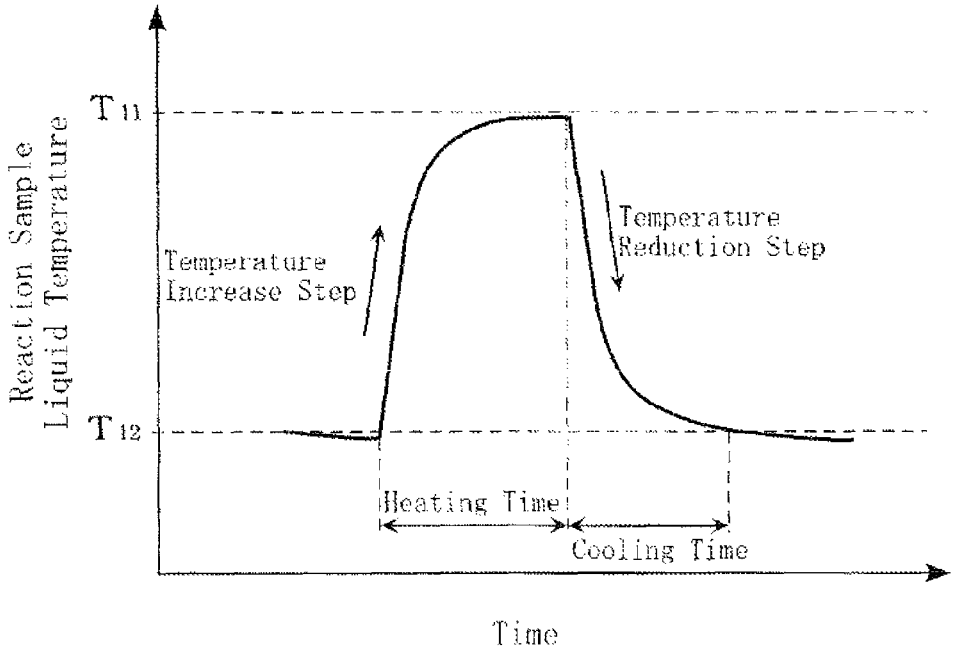
FIG. 20 is a graph showing an example of temperature change of a reaction sample liquid in each cycle of the PCR method performed by the PCR machine of FIG. 17.

In the temperature increase step with the temperature controlling unit X1, the temperature increase speed (dT/dt) can be made advantageously high in a temperature range close to the higher target temperature $T_H$. As described with reference to FIG. 20, according to the conventional PCR machine X2, the temperature increase speed in a temperature range close to the thermal denaturation temperature $T_{11}$ (higher target temperature) in the temperature increase step is considerably low as compared with the temperature increase speed in the initial stage of the temperature increase step. This is because, as the temperature T of the reaction sample liquid increases to approach the thermal denaturation temperature $T_{11}$ (the higher target temperature), the temperature difference ($T_{11}$−T) between the reaction sample liquid and the heating block 92 becomes considerably small. (A smaller temperature difference leads to a smaller amount of heat supply to the reaction sample liquid per unit time and hence to a lower temperature increase speed.) On the other hand, according to the temperature controlling unit X1, the temperature difference ($T_2$−T) between the sample liquid 50 and heating block 12 during temperature increase can be made considerably large even in a temperature range close to the higher target temperature $T_H$ in the temperature increase step. Thus, the amount of heat supply to the sample liquid 50 in the sample liquid cell 43 per unit time (dQ/dt) can be made large. Thus, according to the temperature controlling unit X1, the temperature increase speed (dT/dt) in a temperature range close to the higher target temperature $T_H$ in the temperature increase step can be made large.

Further, the temperature controlling unit X1 is designed such that the cooling block 13 can come into direct contact with the cell wall 42*a* of the sample liquid cell 43 to reduce the temperature of the sample liquid 50. Thus, in the temperature reduction step, the cooling block 13 cools the sample liquid 50 in direct contact with the cell wall 42*a*. In the above-described conventional PCR machine X2, for example, the cooling block 93 needs cool the tube 94 or the reaction sample liquid in the tube via a holding block 91 (heat capacity member) holding the tube 94, and the holding block 91 has a large heat capacity. Thus, in the PCR machine X2, to reduce the temperature of the reaction sample liquid in the tube 94 to the lower target temperature, it is necessary to reduce the temperature of the holding block 91 as well, which has a large heat capacity, to the lower target temperature. Thus, the holding block 91 (heat capacity member) tends to hinder quick temperature reduction of the reaction sample liquid. In the temperature reduction step by the temperature controlling unit X1, on the other hand, the cooling of the sample liquid chip 40 or the sample liquid 50 can be conducted with no intervention of a heat capacity member for holding the sample liquid chip 40. Thus, the temperature controlling unit X1, in which no large heat capacity member intervenes between the cooling block 13 and the sample liquid chip 40 or the sample liquid 50, is suitable for quickly reducing the temperature of the sample liquid 50 in the sample liquid cell 43.

With respect to the temperature controlling unit X1, it is supposed that the temperature of the sample liquid 50 in the sample liquid cell 43 during the temperature reduction step is represented by T, the amount of heat taken from the sample liquid 50 is represented by Q, and time is represented by t. The reducing rate of the temperature, i.e., the temperature reduction speed of the sample liquid 50 in the temperature reduction step (−dT/dt) is proportional to the amount of heat taken from the sample liquid 50 per unit time (dQ/dt). The amount of heat taken from the sample liquid per unit time (dQ/dt) is highly related to the temperature difference ($T-T_3$) between the sample liquid 50 which is the target to be cooled and the cooling block 13 (kept at a third temperature $T_3$ lower than the lower target temperature $T_L$) and is substantially proportional to the temperature difference ($T-T_3$). A larger temperature difference ($T-T_3$) leads to a larger amount of heat taken from the sample liquid per unit time (dQ/dt) and also to a higher temperature reduction speed (−dT/dt). In the conventional PCR machine X2, the temperature of the cooling block 93 is kept at the annealing/elongation temperature $T_{12}$ that is the lower target temperature of the reaction sample liquid, and thus the difference from the temperature T of the reaction sample liquid during the temperature reduction step is ($T-T_{12}$). As will be understood by comparing the temperature controlling unit X1 and the conventional PCR machine X2 on the assumption that the lower target temperatures are equal (i.e., $T_L=T_{12}$), the temperature difference ($T-T_3$) between the sample liquid 50 and the cooling block 13 in the temperature controlling unit X1 can be made larger than the temperature difference ($T-T_{12}$) between the reaction sample liquid and the cooling block 93 in the PCR machine X2 ($T_3<T_L=T_{12}$). As noted before, a larger temperature difference ($T-T_3$) leads to a larger amount of heat taken from the sample liquid 50 in the sample liquid cell 43 per unit time (dQ/dt). Thus, the temperature reduction speed (−dT/dt) of the sample liquid 50 is high.

In the temperature controlling unit X1, the temperature reduction speed (−dT/dt) can be made advantageously high in a temperature range close to the lower target temperature $T_L$. As described with reference to FIG. 20, according to the conventional PCR machine X2, the temperature reduction speed in the temperature reduction step in a temperature range close to the annealing/elongation temperature $T_{12}$ (lower target temperature) is considerably low as compared with the temperature reduction speed in the initial stage of the temperature reduction step. This is because, as the temperature T of the reaction sample liquid reduces to approach the annealing/elongation temperature $T_{12}$ (the lower target temperature), the temperature difference ($T-T_{12}$) between the reaction sample liquid and the cooling block 93 becomes considerably small. (A smaller temperature difference leads to a smaller amount of heat taken from the reaction sample liquid per unit time and hence to a lower temperature reduction speed.) On the other hand, according to the temperature controlling unit X1, the temperature difference ($T-T_3$) between the sample liquid 50 and cooling block 13 during the temperature reduction can be made considerably large even in a temperature range close to the lower target temperature $T_L$ in the temperature reduction step. Thus, the amount of heat taken from the sample liquid 50 in the sample liquid cell 43 per unit time (dQ/dt) can be made large. Thus, according to the temperature controlling unit X1, the temperature reduction speed (−dT/dt) in a temperature range close to the lower target temperature $T_L$ in the temperature reduction step can be made large.

As described above, the temperature controlling unit X1 is suitable for quickly changing (increasing or reducing) the temperature of the sample liquid 50. Although the temperature controlling unit X1 is suitable for use as a PCR machine, which requires quick temperature control, the temperature controlling unit can be used also as other kinds of temperature controlling unit.

Moreover, the temperature controlling unit X1 is suitable for controlling the temperature of the sample liquid 50 precisely to the higher target temperature $T_H$ or the lower target temperature $T_L$. The reason is as follows.

In theory, in the conventional PCR machine X2, as the temperature of the reaction sample liquid T approaches the thermal denaturation temperature $T_{11}$, the reaction sample liquid temperature T and the temperature $T_{11}$ of the heating block 92 become closer to each other, and the temperature increase speed (dT/dt) of the reaction sample liquid, which is substantially proportional to the temperature difference ($T_{11}-T$), approaches 0. Thus, in theory, in the conventional PCR machine X2, the reaction sample liquid temperature T cannot reach the thermal denaturation temperature $T_{11}$ (higher target temperature) within a finite time in the temperature increase step. In practice as well, in the conventional PCR machine X2, the reaction sample liquid temperature T hardly reaches the thermal denaturation temperature $T_{11}$ in the temperature increase step. Thus, it is difficult to cause the reaction sample liquid temperature T to reach the precise thermal denaturation temperature $T_{11}$. In contrast, in the temperature controlling unit X1, the temperature increase speed (dT/dt) of the sample liquid 50 can be made high in a temperature range close to the higher target temperature $T_H$ in the temperature increase step, as described above. This means that the temperature increase speed (dT/dt) of the sample liquid 50 can be kept high until the temperature T of the sample liquid 50 reaches the higher target temperature $T_H$ so that the temperature T of the sample liquid 50 reaches the higher target temperature $T_H$ quickly and reliably. By separating the heating block 12 from the sample liquid chip 40 when the temperature T of the sample liquid 50 in the sample liquid chip 40 has reached the higher target temperature $T_H$, heat transfer from the heating block 12 to the sample liquid chip 40 or the sample liquid 50 can be stopped, whereby temperature increase of the sample liquid 50 can be stopped. The temperature controlling unit X1 having such a structure is suitable for controlling the temperature T of the sample liquid 50 precisely to the higher target temperature $T_H$.

Generally, in reducing the temperature of a liquid by continuously taking heat from the liquid, the temperature of the liquid sometimes continues to drop even after the taking of heat from the liquid is stopped. For instance, in the above-described temperature reduction step of the conventional PCR machine X2, the cooling block 93 is separated from the holding block 91 to stop taking heat from the reaction sample liquid when the reaction sample liquid temperature T reaches the annealing/elongation temperature $T_{12}$ (the lower target temperature). However, even after this, the reaction sample liquid temperature sometimes continues to drop below the annealing/elongation temperature $T_{12}$. Thus, with the conventional PCR machine X2, it is difficult to control the reaction sample liquid temperature T precisely to the annealing/elongation temperature $T_{12}$. In the temperature controlling unit X1, the rotation table 11 holds the sample liquid chip 40 in contact with the cell wall 41*a* of the sample liquid cell 43 of the sample liquid chip 40. (The temperature of the rotation table 11 is set to and kept at the first temperature $T_1$ for keeping the sample liquid 50 at the lower target temperature $T_L$). This prevents the temperature T of the sample liquid 50 from continuing to drop after the separation of the cooling block 13 from the cell wall 42*a*. The temperature controlling unit X1 having this arrangement is suitable for controlling the temperature T of the sample liquid 50 in the temperature reduction step precisely to the lower target temperature $T_L$.

As described above, the temperature controlling unit X1 is suitable for controlling the sample liquid 50 precisely to the higher target temperature $T_H$ or the lower target temperature $T_L$. Although this temperature controlling unit X1 is suitable for use as a PCR machine, which requires precise temperature control, the temperature controlling unit can be used also as other kinds of temperature controlling unit.

As noted before, in the temperature controlling unit X1, the heating block 12 and the cooling block 13 can be individually brought into contact with a side of the sample liquid chip 40 (i.e., the cell wall 42*a*) that is opposite from the rotation table 11. This arrangement is suitable for efficiently realizing holding of the sample liquid chips 40 on the rotation table 11, which is kept at a constant temperature, movement of the heating block 12 for coming into contact with the sample liquid chips 40 (operation for temperature increase of the sample liquid 50) and movement of the cooling block 13 for coming into contact with the sample liquid chips 40 (operation for temperature reduction of the sample liquid 50).

As noted before, in the temperature controlling unit X1, the rotation table 11 has a holding surface 11*a* for holding the sample liquid chips 40 and is rotatable around the axis Ax perpendicular to the holding surface 11*a*. Further, each of the heating block 12 and the cooling block 13 faces the holding surface 11*a* of the rotation table 11 and is movable toward and away from the holding surface 11*a*. This arrangement is suitable for efficiently realizing holding of the sample liquid chips 40 on the rotation table 11, which is kept at a constant temperature, movement of the heating block 12 for coming into contact with the sample liquid chips 40 (operation for temperature increase of the sample liquid 50) and movement of the cooling block 13 for coming into contact with the sample liquid chips 40 (operation for temperature reduction of the sample liquid 50).

As described above, in the temperature controlling unit X1, the holding surface 11*a* includes the first region $S_1$ configured to hold a plurality of sample liquid chips 40 in contact with the sample liquid chips, and the second region S2 configured to hold a plurality of sample liquid chips 40 in contact with the sample liquid chips. Moreover, each of the heating block 12 and the cooling block 13 is configured to come into contact with a plurality of sample liquid chips 40 held in the first region $S_1$ when the heating block or the cooling block faces the first region $S_1$, and configured to come into contact with a plurality of sample liquid chips 40 held in the second region $S_2$ when the heating block or the cooling block faces the second region $S_2$. With this arrangement, it is possible to perform in parallel the temperature increase step with respect to the sample liquid 50 in the sample liquid chips 40 in the first region $S_1$ by the heating block 12 and the temperature reduction step with respect to the sample liquid 50 in the sample liquid chips 40 in the second region $S_2$ by the cooling block 13. Further, it is possible to perform in parallel the temperature increase step with respect to the sample liquid 50 in the sample liquid chips 40 in the second region $S_2$ by the heating block 12 and the temperature reduction step with respect to the sample liquid 50 in the sample liquid chips 40 in the first region $S_1$ by the cooling block 13.

As described above, in the temperature controlling unit X1, the first region $S_1$ and the second region $S_2$ are configured to hold a plurality of sample liquid chips 40 such that the sample liquid chips 40 are arranged on a circle (imaginary circle) around the axis Ax. This arrangement allows switching the position of the sample liquid chips 40 held in the first region $S_1$ and the position of the sample liquid chips 40 held in the second region $S_2$ by 180° rotation of the rotation table 11 or the holding surface 11*a* (rotation about the axis Ax).

As described above, in the temperature controlling unit X1, the sample liquid chip 40 includes cell walls 41*a* and 42*a* facing and spaced from each other, and a sample liquid cell 43 for receiving sample liquid 50 is defined between the cell walls 41*a* and 42*a*. Further, the rotation table 11 can hold the sample liquid chip 40 in contact with the cell wall 41*a* of the sample liquid chip 40, the heating block 12 can come into contact with the cell wall 42*a* of the sample liquid chip 40, and the cooling block 13 can also come into contact with the cell wall 42*a* of the sample liquid chip 40. This arrangement is suitable for efficient heat transfer between sample liquid 50 as a temperature control target and the heating block 12, and heat transfer between the sample liquid 50 and the cooling block 13.

As described above, in the temperature controlling unit X1, the maximum dimension of the sample liquid cell 43 in a direction perpendicular to the spacing direction (vertical direction in FIG. 5B) of the cell walls 41*a* and 42*a* is larger than the maximum dimension of the sample liquid cell 43 in the spacing direction. That is, the sample liquid cell 43 for receiving the sample liquid as a temperature control target is shallow. This arrangement is suitable for increasing the surface area of the sample liquid 50 per unit volume. A large surface area per unit volume of the sample liquid 50 contributes to efficient heat transfer between the sample liquid 50 and the heating block 12 and the heat transfer between the sample liquid 50 and the cooling block 13.

As described above, in the temperature controlling unit X1, the heating block 12 and the cooling block 13 include projections 12*a* and projections 13*a*, respectively, for coming into contact with the cell walls 42. This arrangement is suitable for allowing local heat transfer from the heating block 12 to the sample liquid 50 in the sample liquid cell 43 and local heat transfer from the sample liquid 50 in the sample liquid cell 43 to the cooling block 13. Realizing local heat transfer contributes to enhancement of heat transfer efficiency.

EXAMPLE

The above-described temperature controlling unit X1 was used, and temperature change of a liquid as a temperature control target was measured. Specifically, these were performed as follows.

First, a sample liquid chip 40 with a thermocouple inserted in the sample liquid cell 43 was prepared, and the sample liquid chip 40 was set in the first region $S_1$ of the holding surface 11*a* of the rotation table 11. Then, sample liquid 50 was introduced into the sample liquid cell 43 and mineral oil 60 was supplied into the liquid retaining space 44 in the same manner as shown in FIGS. 6A-6C. The thermocouple of the sample liquid chip 40 was arranged to constantly measure the temperature of the sample liquid 50 in the sample liquid cell 43 by utilizing a circuit provided at the rotation table 11. By operating the rotation table 11, the heating block 12 and the cooling block 13 of the temperature controlling unit X1, the thermal cycle consisting of the temperature increase step of Step 1, the temperature reduction step of Step 2 and the temperature maintaining step of Step 3-5 was repetitively performed with respect to the sample liquid 50 in the sample liquid cell 43 of the sample liquid chip 40, in the same manner as described above with respect to the sample liquid 50 in the sample liquid cells 43 of the sample liquid chips 40 of the first group.

In this Example, the room temperature was 25° C., and the higher target temperature $T_H$ and the lower target temperature $T_L$ for the sample liquid 50 were set to 95° C. and 62° C., respectively. The temperature of the holding surface 11*a* of the rotation table 11 (first temperature $T_1$) was set to 73° C., the temperature of the heating block 12 (second temperature $T_2$) was set to 120° C., and the temperature of the cooling block 13 (third temperature $T_3$) was set to 40° C. The temperature increase step was performed for six seconds, the temperature reduction step was performed for four seconds, and the temperature maintaining step was performed more than 16 seconds. In the temperature increase step of this Example, the heating block 12 was separated from the cell wall 42*a* of the sample liquid chip 40 when the temperature of the sample liquid 50 reached the higher target temperature $T_H$. In the temperature reduction step of this Example, the cooling block 13 was separated from the cell wall 42*a* of the sample liquid chip 40 one hundred milliseconds before the time when the temperature of the sample liquid 50 was expected to reach the lower target temperature $T_L$ (the expected time determined in advance based on experiments or the like).

Figure 15:
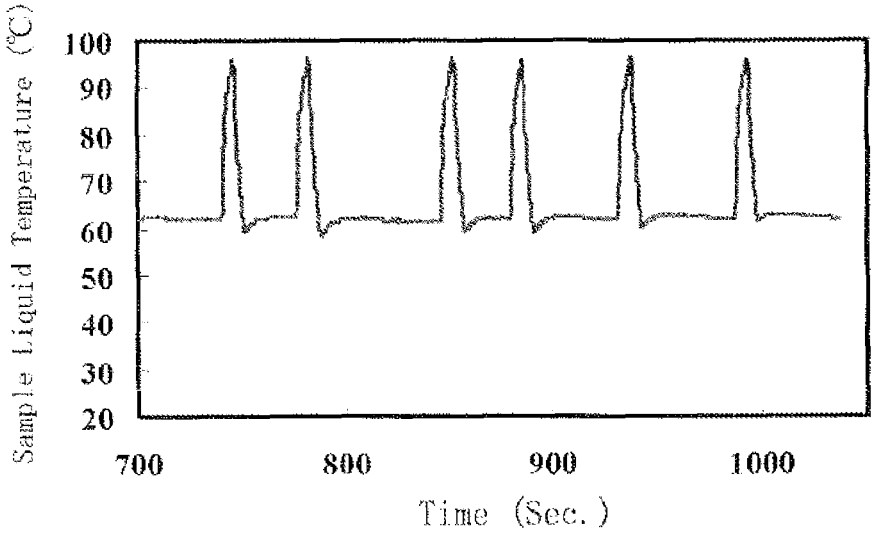
FIG. 15 is a graph showing part of temperature change of a sample liquid in an Example.

Part of the temperature change measured in this Example is shown in the graph of FIG. 15. In the graph of FIG. 15, the horizontal axis indicates time (second), whereas the vertical axis indicates sample liquid temperature (° C.). It is clear from the temperature change shown in the graph of FIG. 15 that the temperature controlling unit X1 can change the temperature of the sample liquid 50 (liquid) quickly and precisely.

COMPARATIVE EXAMPLE

The temperature controlling unit X1, with the temperature control function of the rotation table 11 stopped, was used, and temperature change of a liquid as a temperature control target was measured. Specifically, these were performed as follows.

Similarly to the above-described Example, a sample liquid chip 40 with a thermocouple (and with the sample liquid cell 43 containing sample liquid 50) was prepared and set in the first region $S_1$ of the holding surface 11*a*. Similarly to the Example, the thermocouple of the sample liquid chip 40 was arranged to constantly measure the temperature of the sample liquid 50 in the sample liquid cell 43. In this Comparative Example, the room temperature was 25° C., and the higher target temperature $T_H$ and the lower target temperature $T_L$ for the sample liquid 50 were set to 95° C. and 50° C., respectively. In this Comparative Example, the temperature of the heating block 12 (second temperature $T_2$) was set to 100° C., and the temperature of the cooling block 13 (third temperature $T_3$) was set to 50° C. By operating the rotation table 11 (the temperature control function stopped), the heating block 12 and the cooling block 13 of the temperature controlling unit X1, the thermal cycle consisting of a predetermined temperature increase step and a predetermined temperature reduction step was repetitively performed with respect to the sample liquid 50 in the sample liquid cell 43 of the sample liquid chip 40. In the temperature increase step, the heating block 12 was separated from the cell wall 42*a* of the sample liquid chip 40 when the temperature of the sample liquid 50 reached 95° C., which was the higher target temperature $T_H$. In the temperature reduction step, the cooling block 13 was separated from the cell wall 42*a* of the sample liquid chip 40 when the temperature of the sample liquid 50 reached 50° C., which was the lower target temperature $T_L$.

Figure 16:
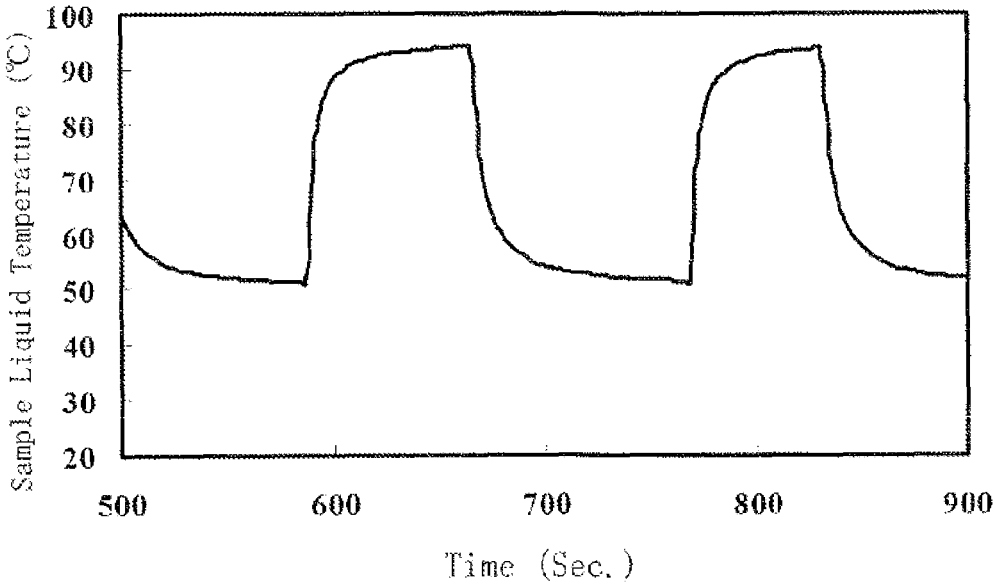
FIG. 16 is a graph showing part of temperature change of a sample liquid in a Comparative Example.
Figure 17:
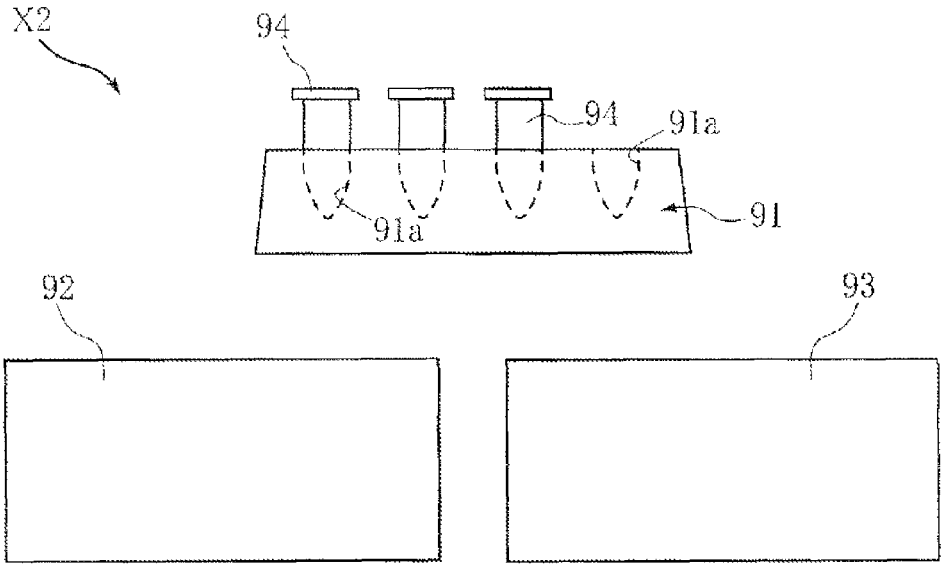
FIG. 17 shows the structure of a conventional PCR machine.
Figure 18:
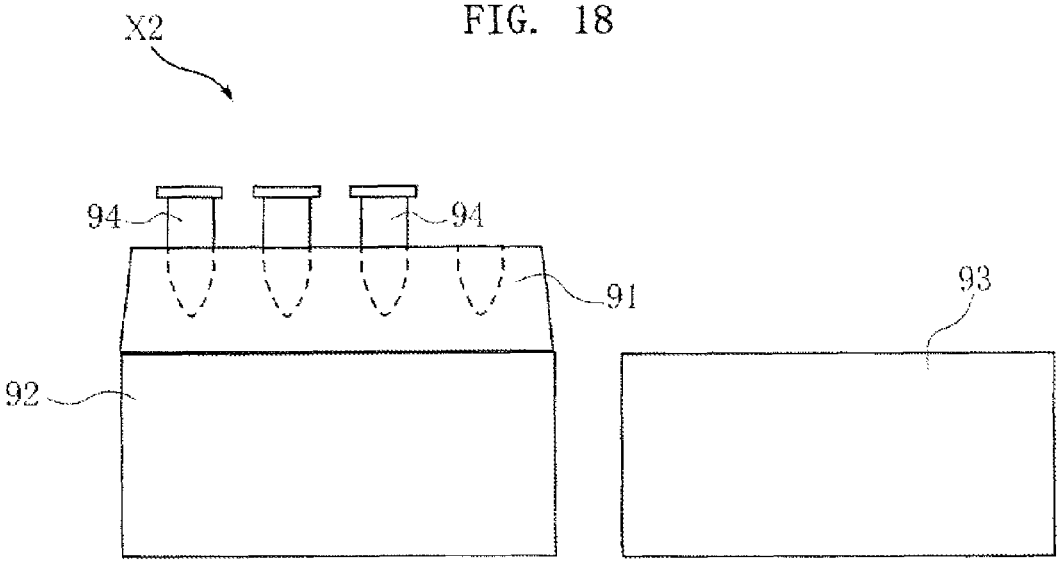
FIG. 18 shows the PCR machine of FIG. 17 during a temperature increase step.
Figure 19:
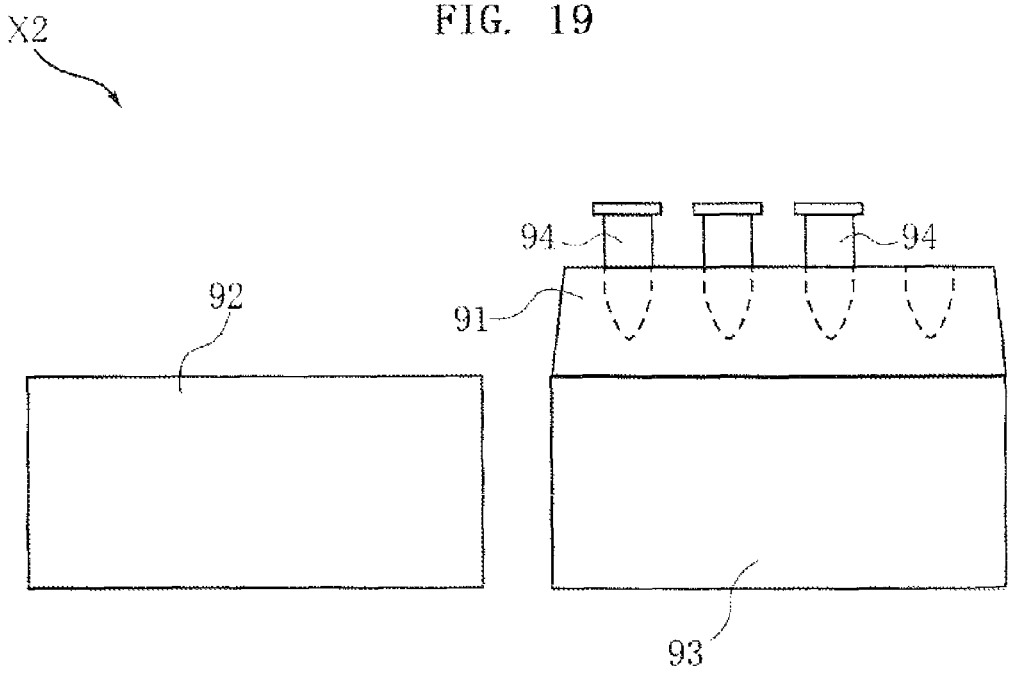
FIG. 19 shows the PCR machine of FIG. 17 during a temperature reduction step.

The temperature change measured in this Comparative Example is shown in the graph of FIG. 16. In the graph of FIG. 16, the horizontal axis indicates time (second), whereas the vertical axis indicates sample liquid temperature (° C.). It is clear from the temperature change shown in the graph of FIG. 16 that it is difficult to change the temperature of the sample liquid 50 (liquid) quickly and precisely according to the Comparative Example. In the temperature increase step of the Comparative Example, it took about 80 seconds to raise the temperature of the sample liquid 50 from about 50° C. to about 95° C. In the temperature reduction step of this Comparative Example, it took about 95 seconds to reduce the temperature of the sample liquid from about 95° C. to about 50° C.

The invention claimed is:

1. A temperature controlling unit comprising:

a holder configured to hold a liquid receiver containing a liquid in contact with the liquid receiver and to maintain a first temperature for keeping the liquid at a lower target temperature;

a heating block configured to increase the temperature of the liquid through contact with the liquid receiver and to move relative to the liquid receiver, the heating block being further configured to maintain a second temperature higher than a higher target temperature that is higher than the lower target temperature, the heating block being spaced apart from the holder when contacting the liquid receiver; and a cooling block configured to reduce the temperature of the liquid through contact with the liquid receiver and to move relative to the liquid receiver, the cooling block being further configured to maintain a third temperature lower than the lower target temperature, the cooling block being spaced apart from the holder when contacting with the liquid receiver, wherein the heating block and the cooling block are configured to move relative to each other, so that the heating block and the cooling block are capable of moving relative to the liquid receiver independently of each other.

2. The temperature controlling unit according to claim 1, wherein the first temperature is selected from the group consisting of a temperature equal to the lower target temperature, a temperature higher than the lower target temperature and lower than the higher target temperature, and a temperature lower than the lower target temperature and higher than the third temperature.

3. The temperature controlling unit according to claim 1, wherein:

the heating block contacts a side of the liquid receiver that is opposite from the holder, and the cooling block contacts a side of the liquid receiver that is opposite from the holder.

4. The temperature controlling unit according to claim 1, wherein:

the holder comprises a surface configured to hold the liquid receiver and is rotatable about an axis perpendicular to the surface; and each of the heating block and the cooling block faces the surface and is movable toward and away from the surface.

5. The temperature controlling unit according to claim 4, wherein:

the holding surface comprises a first region configured to hold a liquid receiver containing a liquid in contact with the liquid receiver and a second region configured to hold a liquid receiver containing a liquid in contact with the liquid receiver; and each of the heating block and the cooling block is configured to move closer to and contact the liquid receiver held in the first region when facing the first region and is configured to move closer to and contact the liquid receiver held in the second region when facing the second region.

6. The temperature controlling unit according to claim 4, wherein:

the holding surface comprises a first region configured to hold a plurality of liquid receivers each containing a liquid in contact with a liquid receiver and a second region configured to hold a plurality of liquid receivers each containing a liquid in contact with a liquid receiver; and each of the heating block and the cooling block is configured to move closer to and contact the plurality of liquid receivers held in the first region when facing the first region and is configured to move closer to and contact the plurality of liquid receivers held in the second region when facing the second region.

7. The temperature controlling unit according to claim 6, wherein the first region and the second region are configured to hold the plurality of liquid receivers such that the liquid receivers are arranged in a circle around the axis.

8. The temperature controlling unit according to claim 1, wherein:

the liquid receiver comprises a first cell wall and a second cell wall facing and spaced from each other, and a cell configured to receive a liquid defined between the first cell wall and the second cell wall;

the holder is configured to hold the liquid receiver in contact with the first cell wall of the liquid receiver;

the heating block is configured to contact the second cell wall of the liquid receiver; and the cooling block is configured to contact the second cell wall of the liquid receiver.

9. The temperature controlling unit according to claim 8, wherein a maximum dimension of the cell in a direction perpendicular to a spacing direction in which the first cell and the second cell are spaced from each other is larger than a maximum dimension of the cell in the spacing direction.

10. The temperature controlling unit according to claim 8, wherein each of the heating block and the cooling block comprises a projection configured to contact the second cell wall.

11. A method for controlling temperature of a liquid comprising:

increasing the temperature of a heating block kept at a temperature higher than a higher target temperature for a liquid into contact with a liquid receiver containing the liquid to increase the temperature of the liquid; and decreasing the temperature of a cooling block kept at a cooling temperature lower than a lower target temperature that is lower than the higher target temperature into contact with the liquid receiver to reduce the temperature of the liquid;

wherein the temperature reducing step is performed with a lower target temperature maintaining member in contact with and holding the liquid receiver, the cooling block being spaced apart from the lower target temperature maintaining member for the temperature reducing step, the lower target temperature maintaining member being kept at a temperature selected from the group consisting of a temperature equal to the lower target temperature, a temperature higher than the lower target temperature and lower than the higher target temperature, and a temperature lower than the lower target temperature and higher than the cooling temperature, wherein the heating block and the cooling block are configured to move relative to each other, so that the heating block and the cooling block are capable of moving relative to the liquid receiver independently of each other.

12. The method according to claim 11, wherein, in the temperature increasing step, the heating block is separated from the liquid receiver when the temperature of the liquid has reached the higher target temperature.

13. The method according to claim 11, wherein, in the temperature reducing step, the cooling block is separated from the liquid receiver before the temperature of the liquid reaches the lower target temperature.

* * * * *